US006770829B1

(12) United States Patent
Hart

(10) Patent No.: US 6,770,829 B1
(45) Date of Patent: Aug. 3, 2004

(54) CONTROL APPARATUS

(75) Inventor: Roy L. Hart, Laguna Niguel, CA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/679,136

(22) Filed: Oct. 2, 2003

(51) Int. Cl.[7] ..... H01H 9/00

(52) U.S. Cl. ..... 200/314; 200/329; 200/292; 200/523; 340/815.4

(58) Field of Search ..... 200/314, 329, 200/292, 520, 523; 340/815.4, 815.47

(56) References Cited

U.S. PATENT DOCUMENTS 4,496,813 A * 1/1985 Fukushima ..... 200/314
5,036,441 A * 7/1991 Herron ..... 362/95
5,636,729 A * 6/1997 Wiciel ..... 200/181
5,878,870 A * 3/1999 Ohtaki ..... 200/314
5,941,372 A * 8/1999 Johnston ..... 200/343
6,310,308 B1 * 10/2001 Watson et al. ..... 200/520

* cited by examiner

*Primary Examiner*—Elvin Enad
*Assistant Examiner*—K. Lee
(74) *Attorney, Agent, or Firm*—Tarolli, Sundheim, Covell & Tummino L.L.P.

(57) ABSTRACT

A control apparatus includes outer housing which encloses a switch assembly and a connector terminal mounting block. The switch assembly includes stationary and movable switch contacts. A push button and actuator link are connected with the movable switch contacts. Light sources are disposed on a light module housing. Conductors extend through openings in the actuator link and are connected with the light sources. The push button is illuminated by light from the light sources. An alternate action mechanism is connected with the push button and is disposed in an opening in the connector terminal mounting block. The switch assembly may be mounted on a printed circuit board with the alternate action mechanism extending through an opening in the printed circuit board.

80 Claims, 25 Drawing Sheets

CONTROL APPARATUS

BACKGROUND OF THE INVENTION

The present invention relates to an apparatus which includes a switch assembly.

Switch assemblies have commonly been utilized to control many different types of devices, including devices disposed in an aircraft. A known switch assembly is disclosed in U.S. Pat. No. 6,153,841. Another switch assembly which may be utilized in association with many different types of devices is disclosed in U.S. Pat. No. 5,659,162. When these known switch assemblies are utilized in an aircraft, it is important to make the switch assembly as light as possible and as compact as possible.

SUMMARY OF THE INVENTION

The present invention provides a new and improved control apparatus which is compact and light weight. The apparatus may include an outer housing which at least partially encloses a switch assembly and a connector terminal mounting block. A plurality of connector terminals associated with the connector terminal mounting block may be connected with electrical conductors. The switch assembly may be connected with connector terminals.

The switch assembly may include a switch housing, a base which is at least partially endosed by the switch housing, and a plurality of switch terminals. A plurality of movable and stationary switch contacts may be connected with the switch terminals. An actuator link may be connected with a push button and the movable switch contacts.

A light module housing may be at least partially endosed by the switch housing. The light module housing may have a first portion in which the movable switch contacts are at least partially disposed and a second portion in which a plurality of light sources are disposed. The push button may be at least partially illuminated by light from the light sources upon energizatlon of the light sources.

A plurality of conductors may be utilized to conduct electrical energy to the light sources. These conductors may extend through the actuator link. Upon movement of the push button, the actuator link may be moved relative to the conductors.

In order to enable the switch contacts to be relatively close to each other, a body of insulating material may be disposed in engagement with a stationary switch contact. The body of insulating material may also engage a conductor connected with another stationary switch contact and/or a switch terminal. The use of the body of insulating material enables the stationary switch contact to be disposed close to the conductor and a switch terminal.

An alternate action mechanism may be connected with the push button. The alternate action mechanism may be disposed in an opening formed in the connector terminal mounting block.

The outer housing may be omitted. The switch assembly may be mounted on a printed circuit board. If this is done, the switch terminals may extend into sockets in the printed circuit board. The alternate action mechanism may extend into an opening in the printed circuit board.

The apparatus of the present invention includes many different features. It is contemplated that these features may advantageously be utilized together. However, it is also contemplated that each of the features may be used separately or in combination with known features from the prior art. Various combinations of the features of the present invention may be utilized with or without features from the prior art

BRIEF DESCRIPTION OF THE DRAWINGS

The foregoing and other features of the invention will become more apparent upon a consideration of the following description taken in connection with the accompanying drawings wherein.

DESCRIPTION OF A SPECIFIC PREFERRED EMBODIMENTS OF THE INVENTION

General Description

Figure 1:
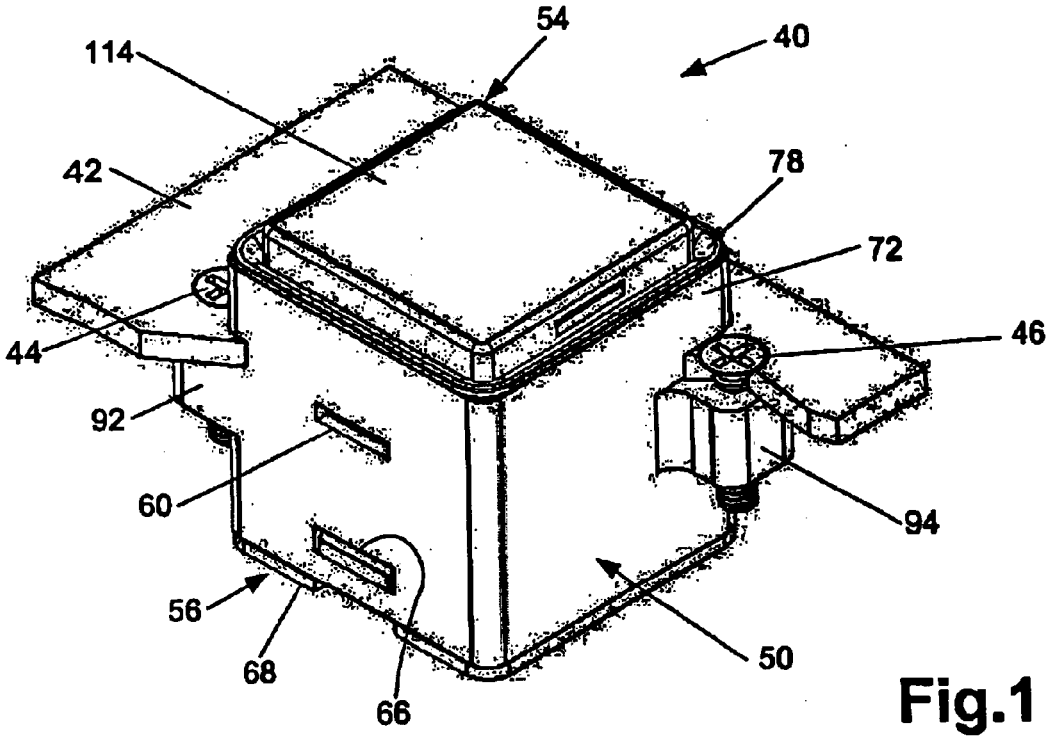
FIG. 1 is a schematic pictorial illustration of an apparatus constructed in accordance with the present invention.
Figure 2:
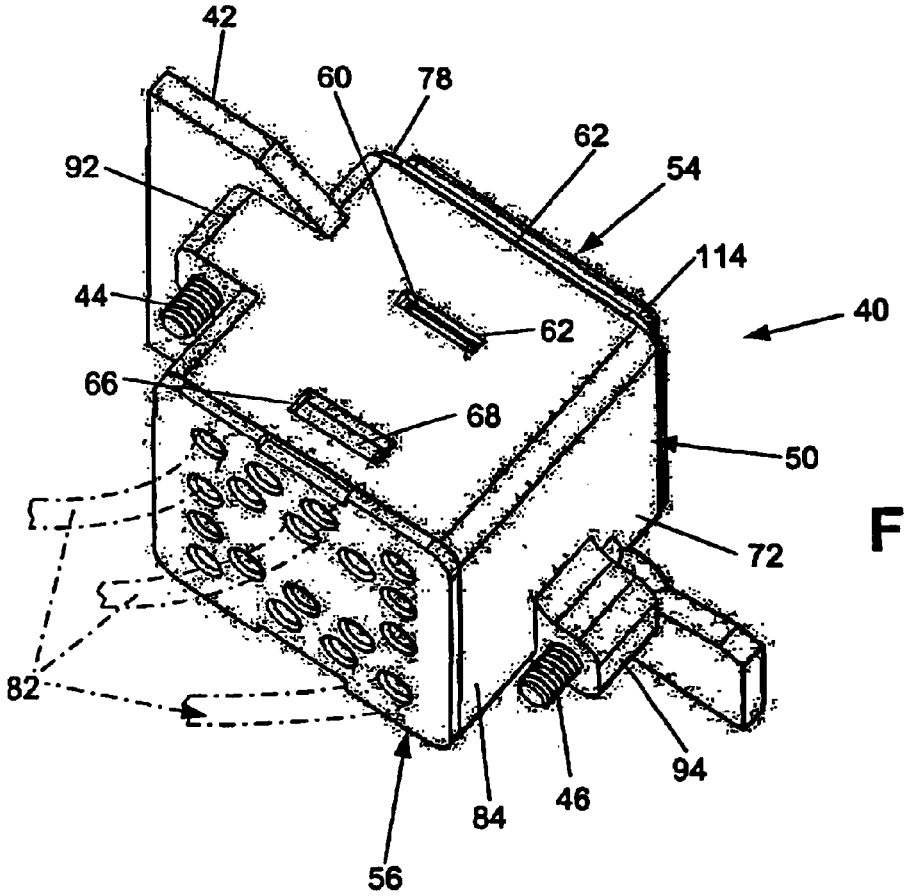
FIG. 2 is a schematic pictorial illustration of a lower side of the apparatus of FIG. 1.

A relatively compact and light weight control apparatus 40 constructed in accordance with the present invention is illustrated in FIGS. 1 and 2. The apparatus 40 is mounted on a control panel 42 by suitable fasteners 44 and 46. The control panel 42 is fixedly connected with a frame of a vehicle, such as an aircraft.

Although only a portion of the control panel 42 has been illustrated schematically in FIGS. 1 and 2, it should be understood that the control panel has a known construction and forms part of an aircraft. Although it is believed that the apparatus 40 may be particularly advantageous in association with an aircraft, it is contemplated that the apparatus may be associated with other vehicles, such as land or water based vehicles. Alternatively, the apparatus 40 may be used in controls for a manufacturing operation in a factory.

Although the apparatus 40 may be used in any desired environment, it is believed that the apparatus will probably be utilized in association with an aircraft. This is because the apparatus 40 has a relatively compact and light weight construction which is particularly well adapted for use in an aircraft. It is believed that the compact and light weight construction of the apparatus 40 will promote its use in either military or commercial type aircraft.

Figure 3:
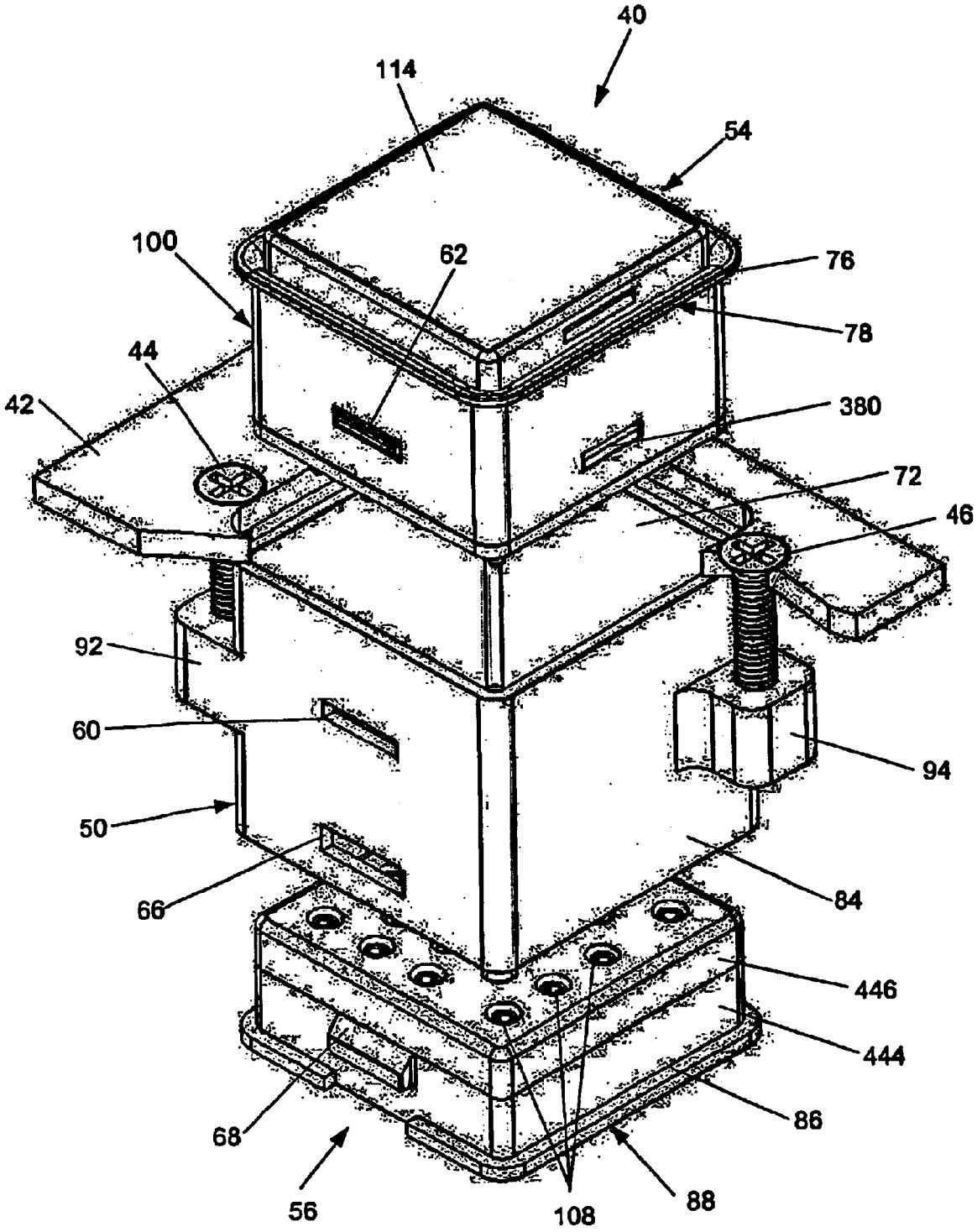
FIG. 3 is an exploded schematic pictorial illustration of the control apparatus of FIG. 1 and illustrating an outer housing, connector terminal mounting block, and a switch assembly.

The apparatus 40 includes an outer housing 50 which is connected with the control panel 42 by the fasteners 44 and 46 (FIGS. 1–3). The rectangular outer housing 50 encloses a switch assembly 54 and a connector terminal mounting block 56. If desired, the outer housing 50 may be omitted.

The rectangular switch assembly 54 is disposed in the open upper (as viewed in FIGS. 1 and 2) portion of the tubular outer housing 50. The rectangular connector terminal mounting block 56 is disposed in the open lower portion of the outer housing 50. The switch assembly 54 and connector terminal mounting block 56 are interconnected by associated terminals.

To facilitate installation of the switch assembly 54 and connector terminal mounting block 56 in the outer housing 50, the switch assembly and connector terminal mounting block snap into the outer housing. The outer housing 50 has an upper (as viewed in FIGS. 1–3) opening 60 which receives a retainer 62 (FIGS. 2 and 3) on the switch assembly 54. The retainer 62 for the switch assembly 54 snaps into the upper opening 60 to securely interconnect the switch assembly 54 and the outer housing 50.

In addition, the outer housing 50 has a lower (as viewed in FIGS. 1–3) opening 66. A retainer 68 on the connector terminal mounting block 56 (FIG. 3) snaps into the lower opening 66 (FIGS. 1 and 2) in the outer housing 50 to interconnect the outer housing and the connector terminal mounting block.

When the rectangular switch assembly 54 is to be mounted in the outer housing 50, the switch assembly is axially aligned with an open upper end portion 72 of the tubular outer housing in the manner illustrated in FIG. 3. The switch assembly 54 is then moved axially downward (as viewed in FIG. 3) into the outer housing 50. As this occurs, a locating surface 76 on a rectangular rim 78 of the switch assembly 54 moves into engagement with a rectangular upper (as viewed in FIG. 3) end surface on the outer housing 50 to position the switch assembly 54 relative to the outer housing.

As the locating surface 76 on the rim 78 of the switch assembly 54 moves into engagement with the upper end portion 72 of the outer housing 50 in the manner illustrated in FIG. 1, the retainer 62 (FIG. 3) on the switch assembly 54 snaps into the upper opening 60 in the outer housing 50. Engagement of the retainer 62 with the upper opening 60 in the outer housing 50 interconnects the switch assembly 54 and the outer housing. In addition, engagement of the retainer 62 with the upper opening 60 in the outer housing 50 is effective to position the switch assembly 54 relative to the outer housing. Thus, the switch assembly 54 is positioned relative to the outer housing 50 by engagement of the locating surface 76 on the rim 78 of the switch assembly with the upper end portion 72 of the outer housing and by engagement of the retainer 62 with the upper opening 60 in the outer housing.

It is contemplated that the rectangular connector mounting block 56 will be connected with the outer housing 50 after a plurality of wires or other electrical conductors 82 (FIG. 2) have been connected with the connector terminal mounting block. Although only three wires 82 have been illustrated schematically in FIG. 2, it should be understood that substantially greater number of wires may be connected with the connector terminal mounting block 56 if desired. In the specific embodiment of the connector terminal mounting block 56 illustrated in FIG. 2, it is contemplated eighteen wires will be connected with the connector terminal mounting block. It is believed that it may be preferred to connect the wires 82 with the connector terminal mounting block 56 before the connector terminal mounting block is mounted in the outer housing 50. Of course, wires 82 may be connected with the connector terminal mounting block 56 after it has been mounted in the outer housing 50 if desired.

When the rectangular connector terminal mounting block 56 is to be mounted in the outer housing 50, the connector terminal mounting block 56 is axially aligned with an open lower end portion 84 of the outer housing 50 in the manner illustrated in FIG. 3. The connector terminal mounting block 56 is then moved axially upward (as viewed in FIG. 3) into the tubular outer housing 50. As this occurs, a locating surface 86 on a rectangular rim 88 of the connector terminal mounting block 56 moves into engagement with the lower end portion 84 of the outer housing 50. At the same time, the retainer 68 snaps into the lower opening 66 in the outer housing 50. This results in the connector terminal mounting block 56 being positioned relative to the outer housing 50 by engagement of the locating surface 86 with the outer housing and by engagement of the retainer 68 with the lower opening 66.

The tubular outer housing 50 extends around both the switch assembly 54 and connector terminal mounting block 56 to position them relative to each other and to hold them against movement relative to each other. However, it should be understood that the outer housing 50 may be omitted or be integrally formed as one piece with a portion of the control panel 42. It is contemplated that the outer housing 50 may not be open at both ends and may not be tubular.

The outer housing 50 is formed from a single piece of metal. The specific outer housing 50 illustrated in FIGS. 1–3 is formed of extruded aluminum. Integral mounting lugs 92 and 94 are formed by machining away excess material. The upper and lower openings 60 and 66 are machined in the metal of the tubular outer housing 50. However, the upper and lower openings 60 and 66 may be formed in a different manner if desired.

The outer housing 50 may have a configuration which is different then the illustrated rectangular configuration and may be formed of material other than metal. For example, the outer housing 50 may have a cylindrical configuration and be formed of a polymeric material. The illustrated open ended housing 50 facilitates mounting of switch assembly 54 and connector terminal mounting block 56 in a coaxial relationship. However, the housing 50 could have a different construction if desired. One or both ends of the housing 50 may be closed.

By snapping the switch assembly 54 and connector terminal mounting block 56 into the outer housing 50, the switch assembly and connector terminal mounting block can be easily installed in the outer housing. It may be desired to disconnect either the switch assembly 54 or the connector terminal mounting block 56 from the outer housing 50 for maintenance purposes. This can be easily done by inserting a suitable tool through the upper opening 60 and/or the lower opening 66 to release the switch assembly 54 and/or connector terminal mounting block 56 for removal from the outer housing 50.

If desired, the switch assembly 54 and/or connector terminal mounting block 56 may be connected with the outer housing 50 by connections other than snap connections. For example suitable fasteners, such as screw or rivet, may be used to connect the switch assembly 54 and/or connector terminal mounting block 56 with the outer housing 50. If desired only one of the switch assembly 54 and connector terminal mounting block 56 may be connected with the housing 50. For example, the switch assembly 54 may be connected to the outer housing 50 and the connector terminal mounting block 56 connected to the switch assembly. Alternatively, the outer housing 50 may be eliminated.

The switch assembly 54 includes a rectangular switch housing 100 (FIGS. 4 and 5) which is telescopically received in the outer housing 50 (FIG. 3). The switch housing 100 (FIGS. 4 and 5) may be formed of a suitable polymeric material having electrical insulating characteristics. Alternatively, the switch housing 100 may be formed of metal.

Regardless of the material of which the switch housing 100 is formed, the switch housing may be integrally formed as one piece and may have a rectangular configuration which corresponds to the rectangular configuration of the open upper end portion 72 of the outer housing 50 (FIG. 3). Of course, if the open upper end portion 72 of the outer housing 50 had a different configuration, the switch housing 100 may have a different configuration. For example, the open upper end portion 72 of the outer housing may be circular and the switch housing 100 may be cylindrical.

In addition, the switch assembly 54 includes a base 104 (FIGS. 4 and 5) which is molded from one piece of a suitable polymeric material having electrical insulating characteristics. A plurality of parallel metal switch terminals 106 extend from the base 104 and correspond to the number of connector terminals disposed in the connector terminal mounting block 56 (FIG. 3). When the switch assembly 54 is disposed in the outer housing 50, the cylindrical switch terminals 106 (FIGS. 4 and 5) extend into cylindrical openings 108 (FIG. 3) in the connector terminal mounting block 56.

The switch terminals 106 may be connected directly with conductors. These conductors may correspond to the wires 82 of FIG. 2. If this is done, the connector terminal mounting block 56 may be omitted. In addition, the outer housing 50 may be omitted. It should be understood that the connector terminal mounting block 56 may be used with the switch assembly 54 with or without the outer housing 50. The outer housing 50 may be used with the switch assembly 54 with or without the connector terminal mounting block 56.

A switch contact assembly 110 (FIGS. 4, 5 and 6) is disposed on the base 104. The switch contact assembly 110 is connected with the rigid metal switch terminals 106. The switch contact assembly 110 is operable between actuated and unactuated conditions to open and close circuits connected with the switch terminals 106.

Figure 4:
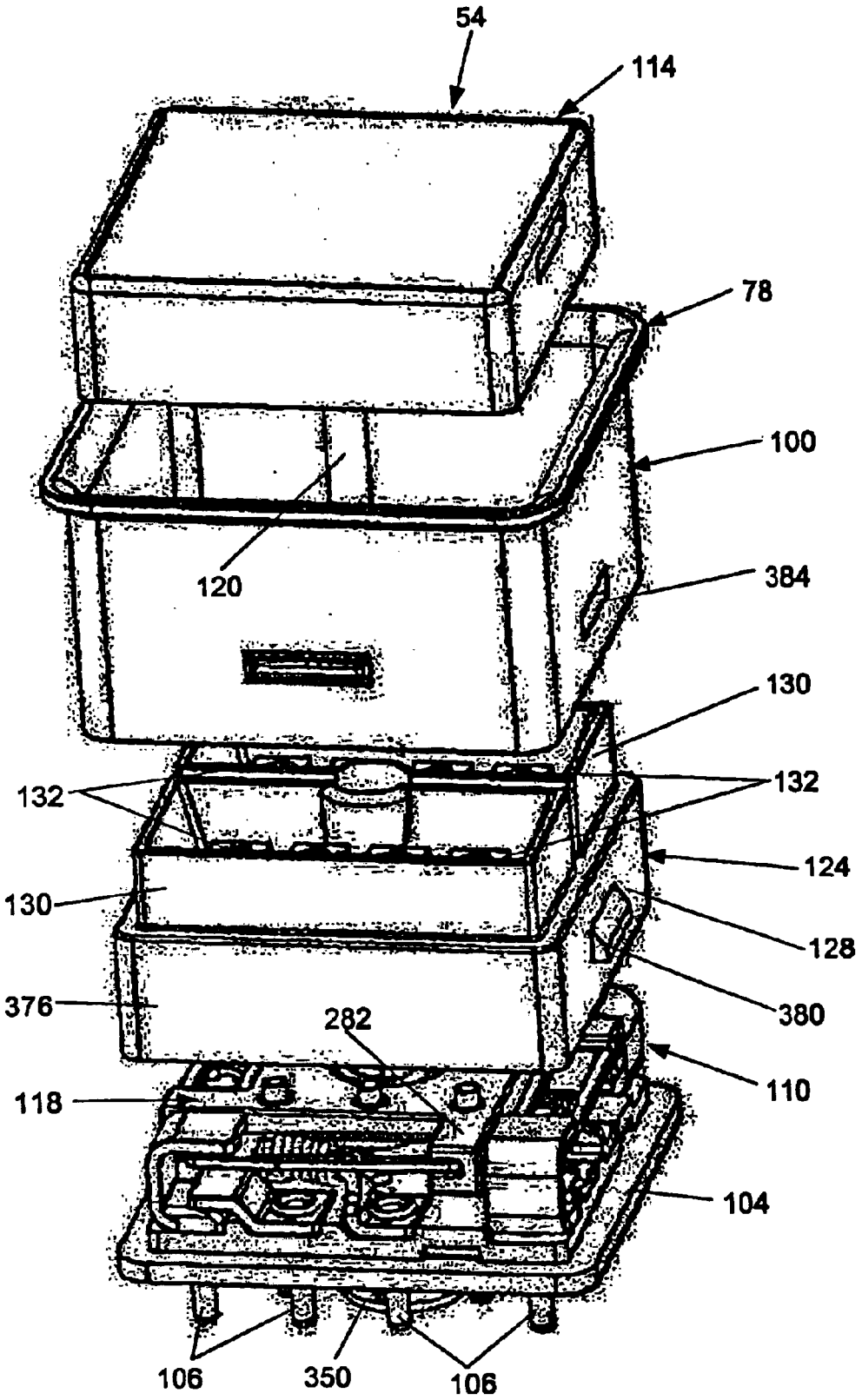
FIG. 4 is an exploded schematic pictorial illustration of the switch assembly of FIG. 3 and illustrating the relationship between a switch housing, a base, electrical contacts, a light module housing, and a push button utilized in the switch assembly.
Figure 5:
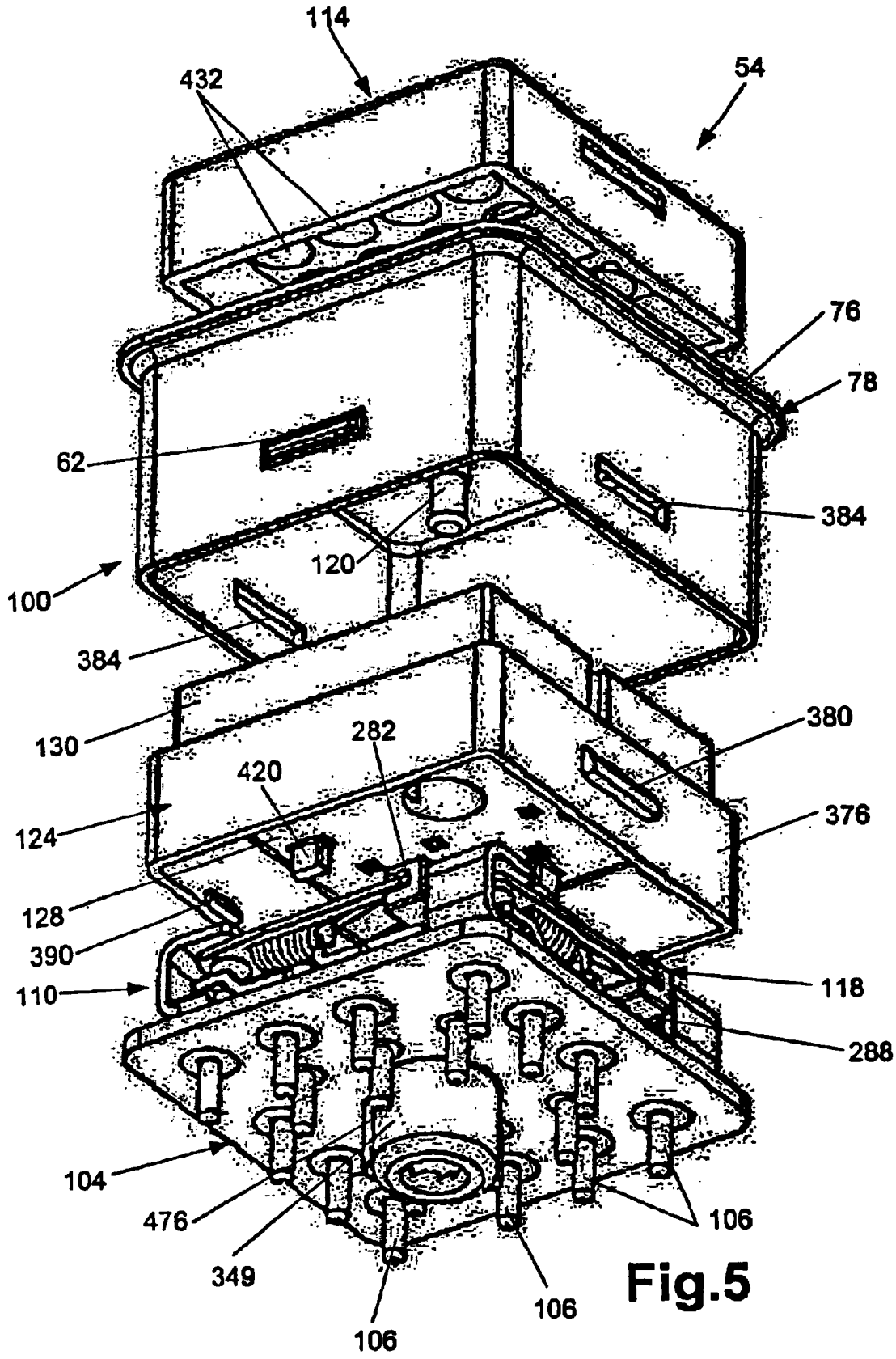
FIG. 5 is an exploded schematic pictorial illustration, generally similar to FIG. 4, further illustrating the construction of the switch assembly.

A push button 114 (FIGS. 3–5) is connected with an actuator link 118 (FIG. 6) for the switch contact assembly 110 by a shaft or force transmitting member 120 (FIGS. 4 and 5). Upon movement of the push button 114 relative to the switch housing 100, the actuator link 118 operates the switch contact assembly 110 between the actuated and unactuated conditions. The actuator link 118 is integrally formed as one piece of electrically insulating polymeric material. If desired, the actuator link 118 may be formed of a plurality of pieces of material at least some of which are not polymeric.

A light module housing 124 (FIGS. 4 and 5) is disposed within the switch housing 100. The light module housing 124 has a lower portion 128 (FIG. 5) which extends around the switch contact assembly 110. In addition, the light module housing 124 has an upper portion 130. The upper portion 130 of the light module housing 124 is telescopically received in the push button 114 (FIG. 22) to prevent light from escaping. The light module housing 124 is impervious to light.

A plurality of light sources 132 (FIGS. 4 and 16) are disposed in the upper portion 130 of the light module housing 124. Although many different types of light sources may be utilized, in the illustrated embodiment of the invention, the light sources 132 are formed by light emitting diodes. The light emitting diodes 132 may have any desired color and be disposed in any desired arrangement within the light module housing 124.

The push button 114 (FIG. 4) is at least partially illuminated by light from the light sources 132 when the light sources are energized. The illumination of the push button 114 by the light sources 132 provides a clear indication to personnel operating the apparatus 40. Thus, all or some of the light sources 132 may be deenergized when the switch contact assembly 110 is an unactuated or initial condition.

Upon actuation of the switch contact assembly 110, all or some of the light sources 132 may be energized to illuminate the push button 114. Alternatively, all or some of the light sources 132 may be energized in response to conditions which are remote from the switch assembly 54. For example, upon operation of or failure of a remote device to operate, all or some of the light sources 132 may be energized to inform personnel viewing the switch assembly of the condition of the remote device.

Figure 6:
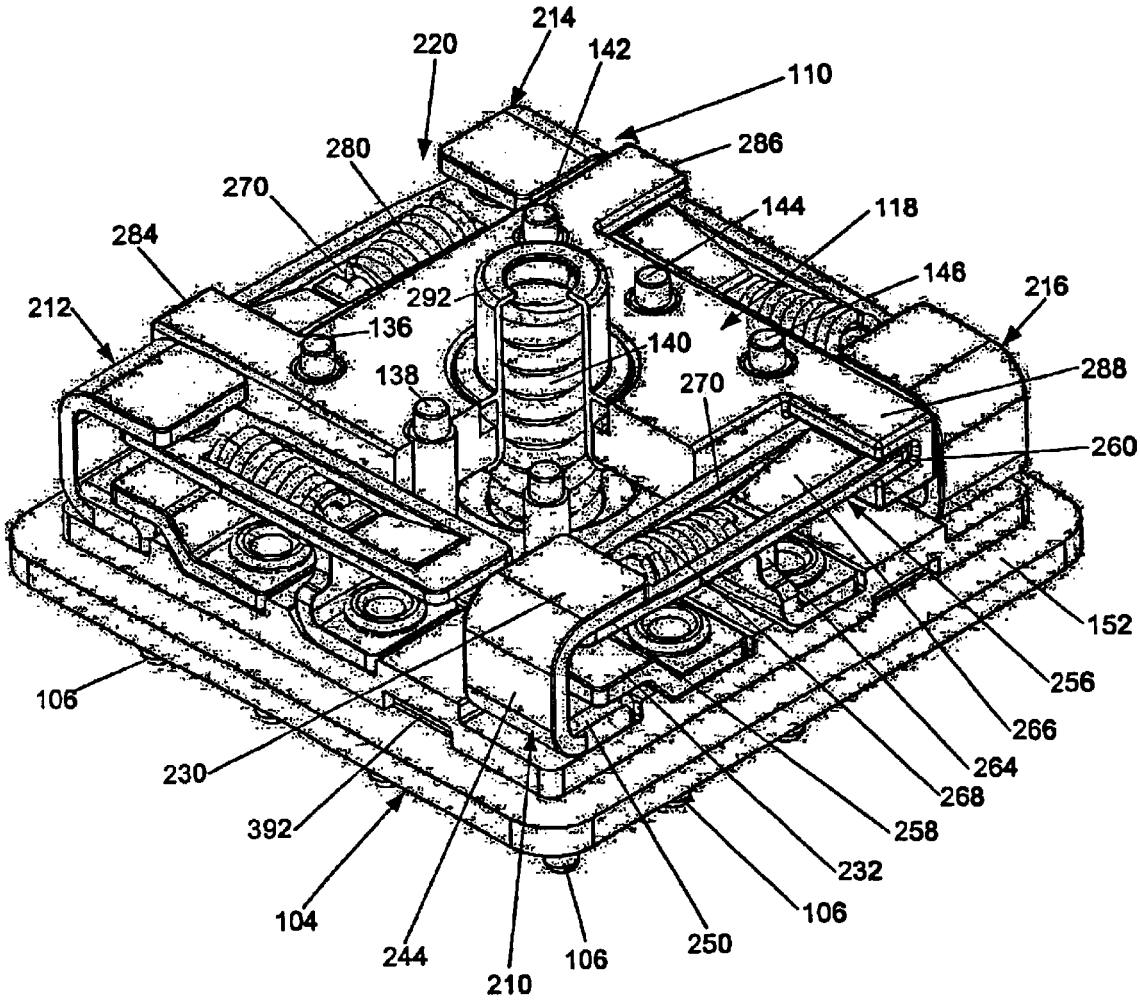
FIG. 6 is an enlarged, partially broken away, schematic pictorial illustration depicting the relationship between the base, electrical contacts, and an actuator link which form part of the switch assembly of FIGS. 3–5.

The light sources 132 are energized by electrical energy conducted through conductors 136, 138, 140, 142, 144 and 146 (FIG. 6). The conductors 136–146 extend through the actuator link 118. Although it is believed that compact construction of the switch assembly 54 is promoted by having the conductors 136–146 extend through the actuator link 118, the conductors may be separate from the actuator link if desired.

Each of the conductors 136–146 is integrally formed as one piece with one of the metal switch terminals 106. The rigid metal conductors 136–146 extend through openings in the actuator link 118 and are fixedly connected to the base 104. When the actuator link 118 is moved relative to the base 104 to operate the switch contact assembly 110 between the actuated and unactuated conditions, the parallel conductors 136–146 assist in guiding movement of the actuator link. If desired, the conductors 136–146 or portions of the conductors may be connected with the actuator link 118 for movement with the actuator link.

Base and Switch Contact Assembly

The base 104 (FIGS. 6–8) is integrally molded from a single piece of an electrically insulating polymeric material. However, if desired, the base 104 may be formed in a different manner. For example, the base 104 may be formed of a plurality of pieces which are interconnected. If the base 104 is formed from a plurality of interconnected pieces, some of the pieces may be formed of an electrically insulating polymeric material while other pieces are formed an electrically conductive material, such as metal.

Figure 7:
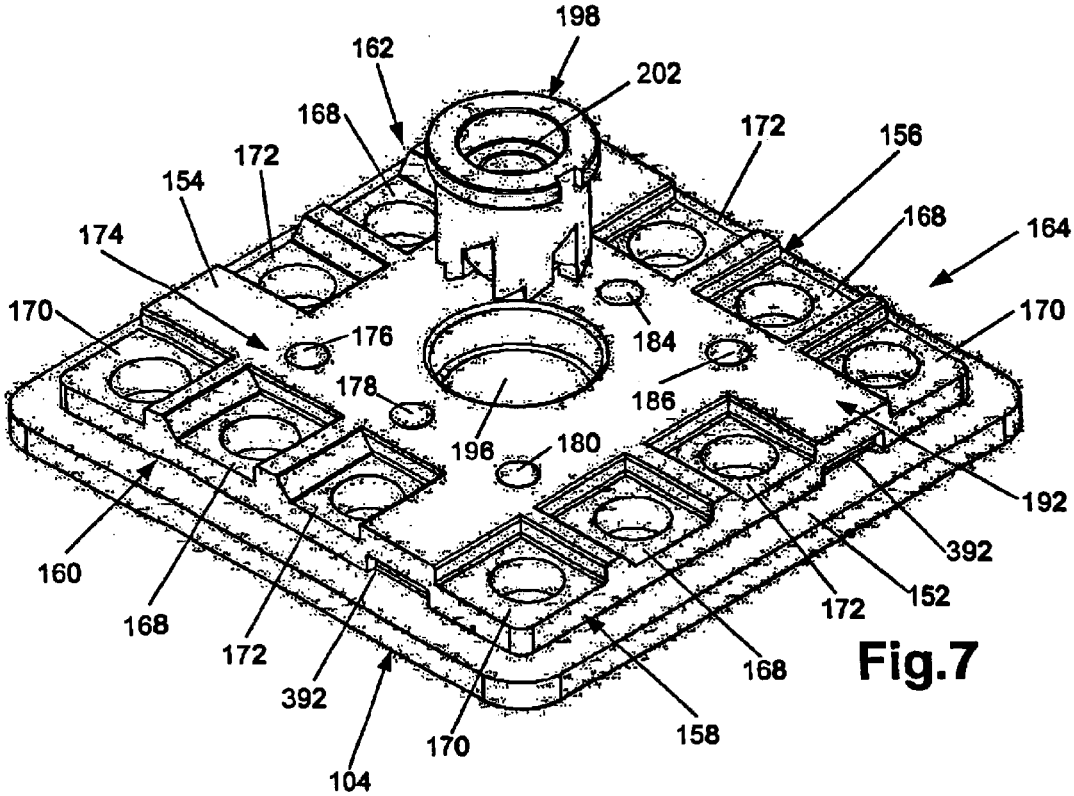
FIG. 7 is a schematic pictorial illustration depicting the base of the switch assembly of FIG. 6 prior to installation of components of the switch assembly and illustrating the manner in which an alternate action cam assembly is to be mounted on the base.

The base 104 has a rectangular rim 152 which is engaged by the light module housing 124 and the switch housing 100 (FIGS. 4 and 5). The base includes a main or central portion 154 from which the rim 152 extends (FIG. 7). The rigid metal switch terminals 106 (FIG. 5) extend downward (as viewed in FIGS. 5 and 7) from and are fixedly connected to the main or central portion 154 of the base 104.

The main or central portion 154 (FIG. 7) of the base 104 is provided with a rectangular array 156 of recesses which receive the switch contact assembly 110 (FIG. 6). The rectangular array 156 of recesses includes four identical groups 158, 160, 162 and 164 of recess (FIG. 7). Each group 158–164 of recesses includes a plurality of identical recesses 168, 170, and 172. The recesses 168–172 are utilized to position contacts in the switch contact assembly 110 (FIG. 6).

Figure 8:
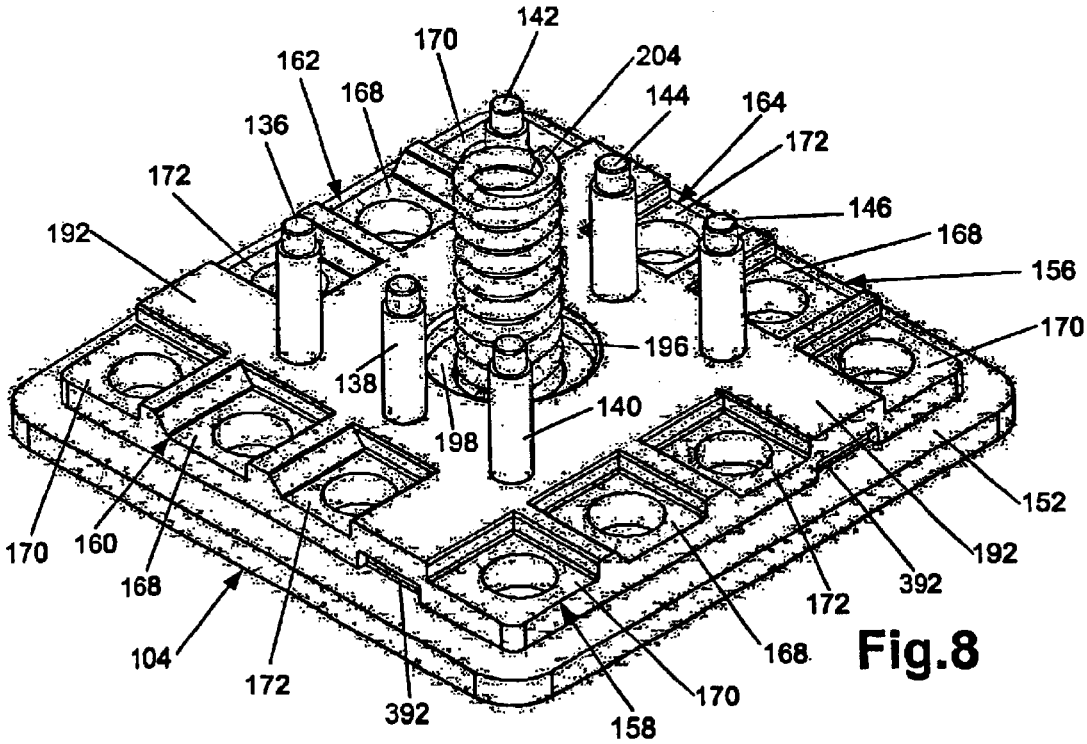
FIG. 8 is a schematic pictorial illustration, generally similar to FIG. 7, illustrating the manner in which a return spring and conductors are mounted on the base after the alternate action cam assembly has been mounted on the base.

In addition, the main or central portion 154 of the base 104 includes a rectangular array 174 of openings which receives the conductors 136–146 (FIG. 8). The array 174 of openings includes an opening 176 which receives the conductor 136. In addition, the array 174 of openings includes openings 178, 180, 184 and 186. The conductor 138 is received in the opening 178. The conductor 140 is received in the opening 180. The conductor 144 is received in the opening 184. The conductor 146 is received in the opening 186. It should be understood that the array 174 of openings includes six openings including an opening (not shown) for the conductor 142.

The rigid cylindrical metal conductors 136–146 are formed as one piece with switch terminals 106 and extend through the base 104. The parallel conductors 136–146 are fixedly connected to the base 104. The conductors extend from the openings in the array 174 of openings in a parallel relationship with each other and perpendicular a flat upper major side surface 192 of the central portion 154 of the base 104 (FIG. 8). If desired, the conductors 136–146 may be formed separately from the switch terminals 106. The conductors 136–146 may be flexible and extend through and/or be connected with the actuator link 118. If desired, the conductors 136–146 may be separate from the actuator link 118.

The base 104 has a relatively large central opening 196 (FIG. 7) which receives an alternate action cam assembly 198. The alternate action cam assembly 198 has an interference fit with the circular opening 196 and is locked in place in the opening. The alternate action cam assembly 198 includes a cylindrical recess 202 which receives an end portion of a helical coil return spring 204 (FIG. 8). The alternate action cam assembly 198 is integrally formed by a single piece of polymeric material. However, the alternate action cam assembly 198 may be formed by a plurality of interconnected pieces at least some of which are formed of a material other than plastic. The illustrated alternate action cam assembly 198 is an assembly of cam surfaces on a unitary structure.

The switch contact assembly 110 (FIG. 6) includes four identical sets 210, 212, 214 and 216 of contacts. Each set of contacts is positioned relative to the base by recesses 168, 170 and 172 (FIG. 7) in the groups 158–164 of recesses. Therefore, the identical sets 210–216 of contacts are connected to the base 104 in a rectangular array 220. The rectangular array 220 of sets 210–216 of contacts is positioned relative to the base 104 by the array 156 of recesses and extends around the conductors 136–146 (FIG. 6). The rectangular array 220 of contacts is disposed inwardly from and is coaxial with the rim 152 of the base 104.

The set 210 of contacts includes an upper (as viewed in FIG. 9) stationary switch contact 230 and a lower stationary switch contact 232. When the set of contacts 210 is in the initial or unactuated condition of FIG. 9, a movable switch contact 236 is disposed in engagement with the upper stationary switch contact 230 and is spaced from the lower stationary switch contact 232. When the set 210 of contacts is in an actuated or transferred condition, a movable switch contact 240 is disposed in engagement with a lower stationary switch contact 232. At this time, the upper movable switch contact 236 is spaced from the upper stationary switch contact 230.

The upper stationary switch contact 230 is connected with a switch terminal 106 by a conductor 244 formed of metal. Similarly, the lower stationary switch contact 232 is connected with a switch terminal 106 by a conductor 246 formed of metal. The conductor 244 extends from a switch terminal 106 upward (as viewed in FIG. 9) past the movable switch contacts 236 and 240 to the stationary switch contact 230.

The upper stationary switch contact 230 and conductor 244 (FIG. 9) of the set 210 of contacts are connected with a switch terminal 106 which is aligned with the recess 170 (FIG. 7) in the group 158 of recesses. Similarly, the lower stationary switch contact 232 and conductor 246 (FIG. 9) of the set 210 of contacts are connected with a switch terminal 106 which is aligned with the recess 168 in the group 158 of recesses. The upper and lower stationary switch contacts 230 and 232 in the sets of contacts 212, 214 and 216 (FIG. 6) are connected with switch terminals 106 which are aligned with recesses 168 and 170 (FIG. 7) in the groups 160, 162 and 164 of recesses in the same manner as previously explained for the set 210 of contacts.

In order to enable the set 210 of contacts to be relatively compact, a body 250 (FIG. 9) of insulating material is disposed between the lower stationary switch contact 232 and an upper end portion of the switch terminal 106 to which the conductor 244 is connected. The body 250 of insulating material covers both the conductor 244 and the upper end portion of the switch terminal 106 to which the conductor is connected. The body 250 of insulating material fills the space between the metal lower stationary switch contact 232 and the metal upper end portion of the terminal 106 to which the upper stationary switch contact 230 is connected by the metal conductor 244. In addition, the body of insulating material 250 covers the end of the conductor 244 disposed beneath (as viewed in FIG. 9) the lower stationary switch contact 232. The portion of the metal conductor 244 extending upward from the switch terminal 106 is free of insulating material.

Although the body 250 of insulating material covers the upper end portion of the switch terminal 106 connected with the upper stationary switch contact 230 and the lower end portion of the conductor 244 connected with the upper stationary switch contact, the upper end portion of the switch terminal 106 to which the upper stationary switch contact 230 is connected has the same configuration as the upper end portion of the switch terminal 106 to which the lower stationary switch contact and conductor 246 are connected. If desired, the conductor 244 connected with the upper stationary switch contact 230 may be connected with a switch terminal 106 in such a manner as to have the upper end of the switch terminal disposed below or fully enclosed by the conductor 244. If this is done, the body 250 of insulating material would engage only the conductor 244. Similarly, if the portion of the switch terminal 106 disposed above the conductor 244 was relatively large, the body 250 of insulating material may engage only the upper end portion of the switch terminal 106.

The body 250 of insulating material is held in position between the lower stationary switch contact 232 and the switch terminal 106 connected with the upper stationary switch contact 230 by being clamped between the lower stationary switch contact and the switch terminal. However, the body 250 of insulating material may be secured to the upper end portion of the switch terminal 106 or the conductor 244 by a suitable adhesive, a mechanical interconnection or a fastener if desired. Regardless of how the body 250 of insulating material is secured in place, the body of insulating material enables the lower stationary switch contact 232 to be relatively close to the switch terminal 106 and the conductor 244 without short circuiting.

Figure 9:
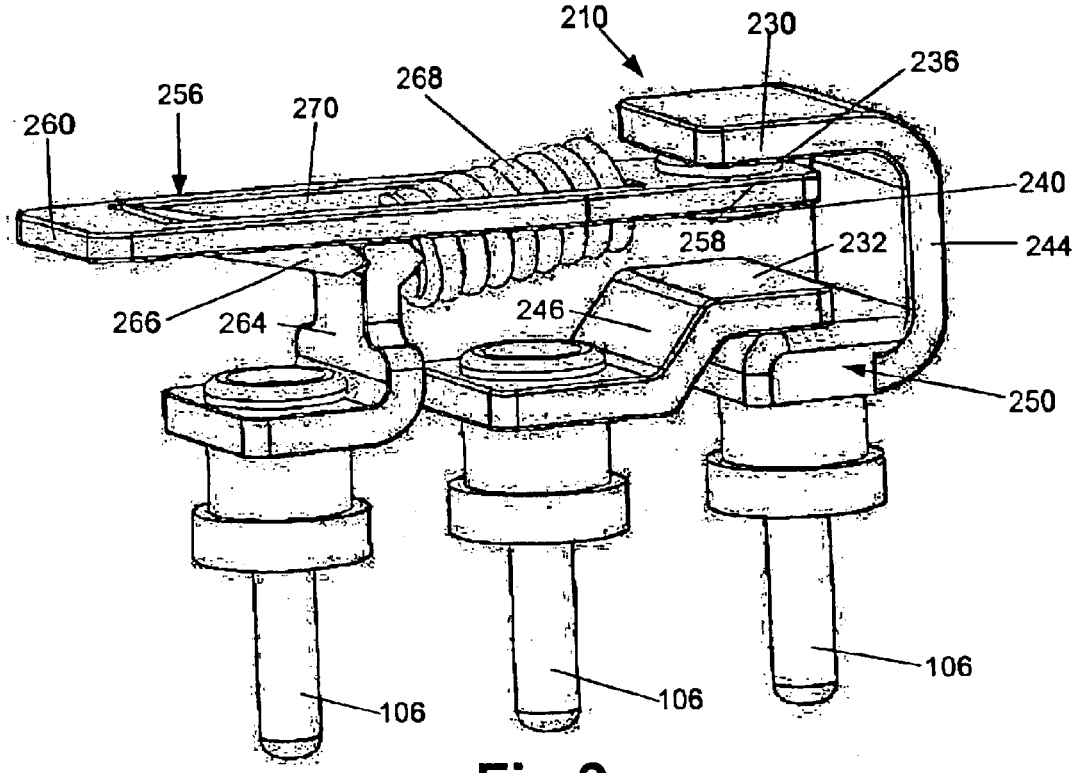
FIG. 9 is an enlarged schematic pictorial illustration depicting a relationship between stationary and movable contacts, switch terminals, and a body of insulating material in the switch assembly of FIGS. 3–5.

Although only the body 50 of insulating material for the set 210 of contacts is illustrated in FIG. 9, similar bodies of insulating material are provided in association with the sets 212, 214 and 216 of contacts. The body 250 of insulating material may be formed as a molded boot of electrically insulating polymeric material. Of course, the body 250 of insulating material may be formed in a different manner and of a different material if desired.

The set 210 of contacts includes a metal actuator lever 256 having a right (as viewed in FIG. 9) end portion 258. The movable switch contacts 236 and 240 are disposed on opposite sides of the end portion 258. The actuator lever 256 has a left (as viewed in FIG. 9) end portion 260. The left end portion 260 of the actuator lever 256 is engaged by the actuator link 118 (FIG. 6).

The metal actuator lever 256 is connected with a metal pivot post 264 by a metal pivot lever 266. A metal actuator lever spring 268 extends between the pivot post 264 and the end portion 258 of the actuator lever 256. The actuator lever spring 268 is disposed in a rectangular opening 270 (FIG. 6) formed in the actuator lever 256. The actuator lever spring 268 is a helical coil spring which is relatively compact and tends to minimize the height of the set 210 of contacts.

The pivot post 264 (FIG. 9) is connected with one of the switch terminals 106. The switch terminal 106, to which the pivot post 264 is connected, is aligned with the recess 172 (FIG. 7) in the group 158 of recess. The pivot post 264 and the switch terminal 106 to which it is connected are formed of metal. The pivot post 264 and switch terminal 106 may be formed of a single piece of metal if desired.

When the actuator lever 256 is in the unactuated or initial position shown in FIGS. 6 and 9, the movable switch contact 236 engages the upper stationary switch contact 230. At this time, the actuator spring 268 provides a biasing force urging the actuator lever 256 to pivot in a counterclockwise direction about the end portion 260 of the actuator lever. This force presses the movable switch contact 236 against the upper stationary switch contact 230. In addition, the actuator lever spring 268 applies a force against the actuator lever 256 urging the actuator lever toward the right (as viewed in FIG. 9) along a longitudinal central axis of the actuator lever. This results in the pivot lever 266 being pressed firmly against the pivot post 264 by the actuator lever 256.

When the movable switch contacts 236 and 240 are moved from the unactuated position shown in FIG. 3, to an actuated position, the actuator lever 256 is first pivoted in a counterclockwise direction about the end portion 258 by the actuator link 118 (FIG. 6). As this occurs, the end portion 260 (FIG. 9) of the actuator lever 256 moves into alignment with the pivot lever 266. As this occurs, the pivot lever 266 moves from a downward and rightward (as viewed in FIG. 9) sloping orientation toward a horizontal orientation. The pivot lever 266 causes the actuator lever 256 to shift axially toward the left (as viewed in FIG. 9). This results in a sliding or wiping of the movable switch contact 236 along the upper stationary switch contact 230.

As the actuator lever 256 is pivoted in a counterclockwise direction about the end portion 258 by the actuator link 118, the force applied by the actuator spring 268 against the actuator lever 256 opposing pivotal movement of the actuator lever about the end portion 258 decreases. When the end portions 258 and 260 of the actuator lever 256 are aligned or horizontal (as viewed in FIG. 9), the actuator lever spring 268 is ineffective to resist further pivotal movement of the actuator level 256.

Once this has occurred, the next increment of counterclockwise pivotal movement of the actuator lever 256 about the end portion 258 of the actuator lever by the actuator link 118 results in the actuator lever spring 268 being moved to an overcenter condition. As this occurs, the actuator lever spring 268 urges the end portion 258 of the actuator lever 256 downward toward the lower stationary switch contact 232 with a snap action. At the same time, the actuator link 118 pivots the actuator lever 256 in a counter-clockwise direction about the end portion 258 of the actuator lever. This results in the movable switch contact 240 moving quickly downward into engagement with the lower stationary switch contact 232.

As this occurs, the pivot lever 266 moves from the horizontal (as viewed in FIG. 9) orientation to an upward and rightward sloping orientation. This results in the actuator lever 256 being moved toward the right (as viewed in FIG. 9) along its longitudinal central axis by the actuator lever spring 268. Therefore, as the lower movable switch contact 240 is moved into engagement with the stationary lower switch contact 232, the actuator lever 256 is moved axially to slide the movable switch contact 240 along the surface of the lower stationary switch contact 232 with a wiping action.

When the movable switch contact 240 is disposed in engagement with the lower stationary switch contact 232, the actuator lever spring 268 provides a biasing force urging the actuator lever 256 to pivot in a clockwise direction about the end portion 258 of the actuator lever 256. This force presses the movable switch contact 240 against the lower stationary switch contact 232. In addition, the actuator lever spring 268 applies force against the actuator lever 256 urging the actuator lever toward the right (as viewed in FIG. 9) along the longitudinal central axis of the actuator lever. This results in the pivot lever 266 being pressed firmly against the pivot post 264 by the actuator lever 256.

The switch assembly 54 is of the alternate action type. Therefore, when the push button 114 (FIGS. 4 and 5) is depressed, the set 210 of contacts (FIG. 9) is operated to the actuated condition in the manner previously explained. When the push button 114 is released, the set 210 of contacts remains in the actuated condition. At this time, the switch assembly 54 may be referred to as being in a latched condition in which the sets 210–216 (FIG. 6) of contacts are maintained in an actuated condition.

When the switch assembly 54 is to be operated from the latched condition back to the unactuated or initial condition, the push button 114 is again depressed and then released. As the push button 114 is released, the set 210 of contacts is operated from the actuated condition to the unactuated condition.

When the set 210 of contacts is to be operated from the actuated condition back to the unactuated or initial condition of FIG. 9, the actuator lever 256 is first pivoted in a clockwise direction about the end portion 258 of the actuator lever. As this occurs, the pivot lever 266 moves from an upward and rightward sloping orientation toward a horizontal orientation. Simultaneously therewith, the actuator lever 256 is shifted toward the left (as viewed in FIG. 9) along its longitudinal central axis by the pivot lever 266 this results in a sliding of the lower movable switch contact 240 along the lower stationary contact 232. As the actuator lever 256 approaches a horizontal (as viewed in FIG. 9) orientation the pivot lever 266 moves into the opening 270 in the actuator link 256 and becomes aligned with the actuator link. As this occurs, the force applied against the actuator lever 256 by the actuator lever spring 268 resisting pivotal movement of the actuator lever decreases.

The next increment of clockwise pivotal movement of the actuator lever 256 about the end portion 258 of the actuator level results in the actuator spring 268 moving through an overcenter condition. As this occurs, the actuator lever 256 and actuator lever spring 268 cooperate to quickly move the actuator lever to the position illustrated in FIG. 9. As this occurs, the movable switch contact 236 snaps into engagement with the upper stationary switch contact 230.

As the upper movable switch contact 236 is moved into engagement with the upper stationary switch contact 230, the pivot lever 266 moves from the horizontal orientation to a downward and rightward sloping orientation of FIG. 9. This results in a rightward (as viewed in FIG. 9) sliding movement of the movable switch contact 236 along the upper stationary switch contact 230 with a wiping action. This rightward sliding movement of the movable switch contact 236 occurs under the influence of force transmitted from the actuator lever spring 268 to the actuator lever 256.

The foregoing description of the manner in which the movable switch contacts 236 and 240 are moved into and out of engagement with the upper and lower stationary switch contact 230 and 232 is in regard to an embodiment of the invention in which the switch assembly 54 is of the alternate action type. When the switch assembly 54 is of the alternate action type, actuation of the push button 114 results in movement of the movable switch contact 236 out of engagement with the upper stationary switch contact 230 and movement of the movable switch contact 240 into engagement with the lower stationary switch contact 232. Upon subsequent release of the push button, the switch assembly 54 is latched in an engaged condition with the movable switch contact 240 in engagement with the lower stationary switch contact 232. Upon subsequent actuation of the push button 114, the movable switch contact 240 is moved out of engagement with the lower stationary switch contact 232 and the movable switch contact 236 moves into engagement with the upper stationary switch contact 230.

It should be understood that the switch assembly 254 may be constructed so as to be of the momentary actuation type. When the switch assembly 54 is of the momentary actuation type, the set of contacts 210 is held in the engaged condition only as long as the push button 114 is manually depressed. As soon as the push button 114 is released, the set 210 of contacts moves from the actuated condition back to the unactuated or initial condition of FIG. 9. It should be understood that the switch assembly 54 may be constructed so as to be of either the alternate action type or the momentary action type.

The sets 210–216 of contacts all have the same construction and same mode of operation. The sets 210–216 of contacts have the same construction as is disclosed in U.S. Pat. No. 5,659,162. The disclosure in the aforementioned U.S. Pat. No. 5,659,162 is hereby incorporated herein in its entirety by this reference thereto. If desired, the sets 210–216 of contacts may have a different construction. For example, the sets 210–211 of contacts may have the construction disclosed in U.S. Pat. No. 3,315,535.

The actuator link 118 has a rectangular body 280 from which a plurality of arms 282, 284, 286 and 288 (FIGS. 6 and 10) extend. The arm 282 (FIG. 4) is connected with the set of contacts 212 (FIG. 6). The arm 284 is connected with a set of contacts 214. The arm 286 is connected with the set of contacts 216 and the arm 288 is connected with the set of contacts 210. The arms 282–288 engage the actuator levers 256 in the associated set of contacts 210–216.

Figure 10:
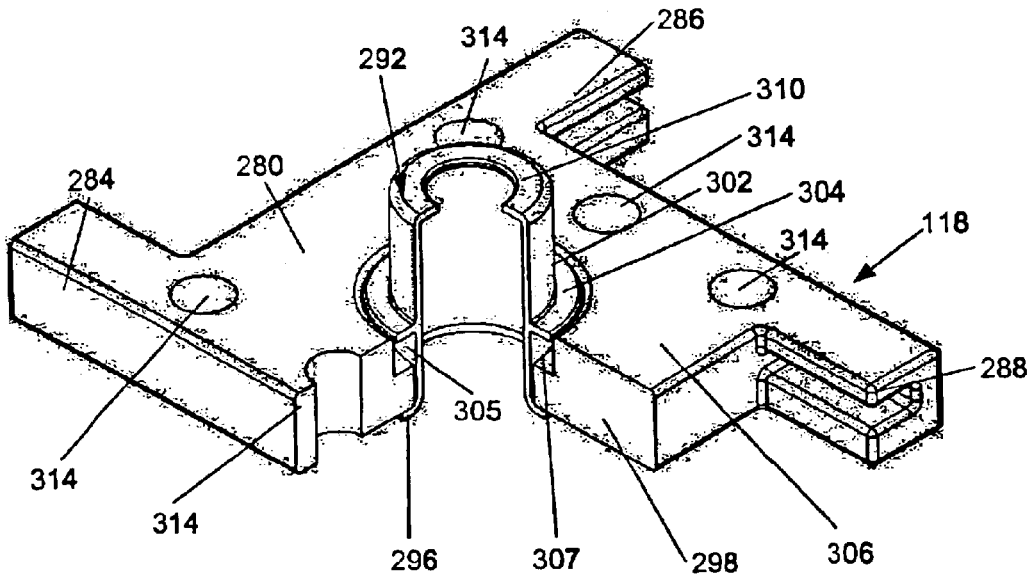
FIG. 10 is a schematic pictorial illustration depicting the construction of an actuator link which is utilized to move contacts in the switch assembly of FIGS. 3–5.

A spring housing 292 is connected with the central portion of the body 280 of the actuator link 118 (FIG. 10). The cylindrical metal spring housing 292 encloses the helical coil return spring 204 (FIGS. 6 and 8). The spring housing 292 extends through a cylindrical central opening in the actuator link 118.

A lower annular collar 296 extends from a lower (as viewed in FIG. 10) end portion of the spring housing 292. The annular lower collar 296 is engagable with and engages a lower major side surface 298 on the actuator link 118 (FIG. 10). The spring housing 292 has a cylindrical body 302 which extends upward from the lower collar 296 and is disposed in a coaxial relationship with the lower collar.

An annular upper collar 304 (FIG. 10) extends radially outward from the cylindrical body 280 of the spring housing 292 and is engagable with an annular seat 305 in a recess 307. The seat 305 extends parallel to an upper major side surface 306 of the actuator link 118. The lower and upper major side surfaces 298 and 306 of the actuator link 118 extend parallel to each other. The upper collar 304 is spaced from the lower collar 296 by an axial distance which is greater than the distance between the lower major side surface 298 and the seat 305. Therefore, the spring housing 292 is movable relative to the actuator link 118. This allows the actuator link 118 to be moved relative to the spring housing 292 by the sets 210–216 (FIG. 6) of contacts when the sets of contacts move between the actuated and unactuated conditions with a snap action.

The spring housing 292 has an upper (as viewed in FIG. 10) end portion with an annular flange 310 (FIG. 10) which extends radially inward from the body 302 of the spring housing 292. The flange 310 engages the upper end portion of the return spring 204 in the manner illustrated in FIG. 6. The flange 310 presses the return spring 204 against the alternate action cam assembly 198 (FIG. 7) which is fixedly mounted in the base 104 (FIG. 8) of the switch assembly 54.

The actuator link 118 has a plurality of openings 314 which extend through the body 280 of the actuator link 118. The parallel cylindrical openings 314 receive the conductors 136–146 (FIG. 6). The actuator link 118 is movable along the rigid parallel cylindrical conductors 136–146 during operation of the sets 210–216 of contacts between the actuated and unactuated condition. The actuator link 118 is formed of an electrically insulating material to insulate the conductors 136–146 from each other.

The manner in which the actuator link 118 cooperates with the end portions 260 (FIG. 9) of the actuator levers 256 in the sets 210–216 (FIG. 6) of contacts is the same as is disclosed in U.S. Pat. No. 6,153,841. The disclosure in the aforementioned U.S. Pat. No. 6,153,841 is hereby incorporated herein in its entirety by this reference thereto.

Figure 11:
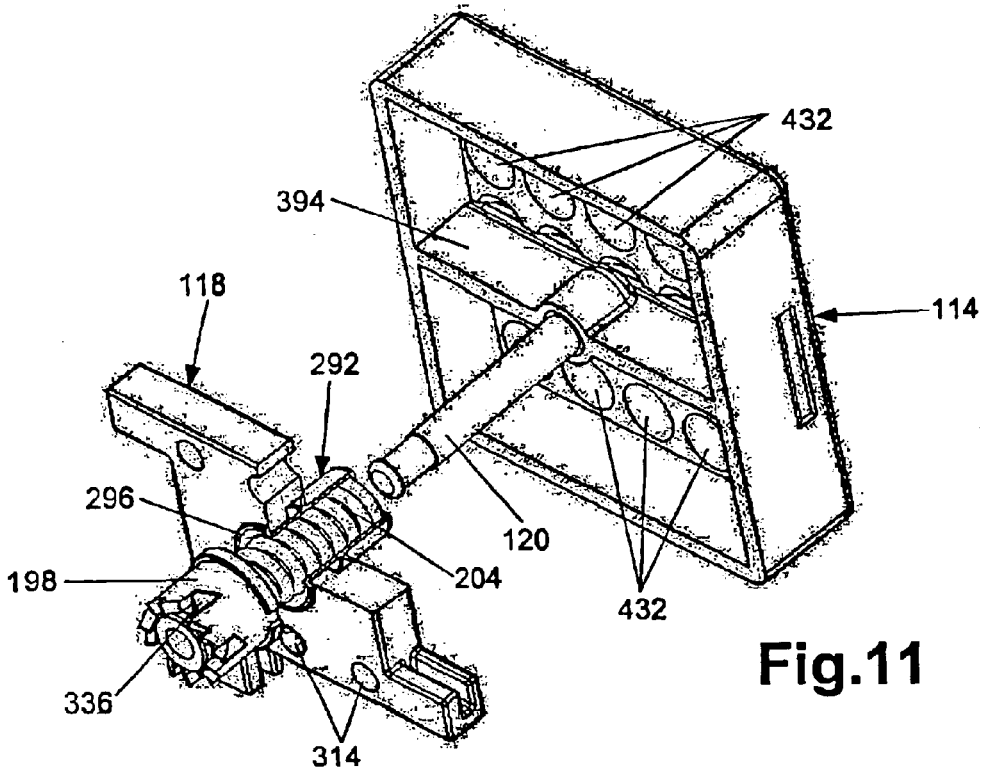
FIG. 11 is an exploded, partially broken away, schematic pictorial illustration depicting the relationship between a push button, actuator link, return spring, and alternate action cam assembly which form part of the switch assembly.

The push button 114 (FIG. 11) is connected with the actuator link 118 by the shaft or force transmitting member 120. The shaft or force transmitting member 120 extends through the circular flange 310 (FIG. 10) at the end of the spring housing 292. The return spring 204 is effective to urge the push button 114 away from the base 104.

The shaft or force transmitting member 120 is coaxial with and extends through the alternate action cam assembly 198. The return spring 204 is compressed between the flange 310 on the spring housing 292 and the alternate action cam assembly 198. As was previously mentioned, the alternate action cam assembly 198 is fixedly secured to the base 104 (FIGS. 7 and 8). However, the shaft 120 is movable in an axial direction relative to the alternate action cam assembly 198.

When the sets of contacts 210–216 are in the initial or unactuated condition illustrated in FIG. 9 for the set 210 of contacts, the return spring 204 presses the lower collar 296 on the spring housing 292 against the lower major side surface 298 (FIG. 10) of the actuator link 118. At this time, the upper collar 304 on the spring housing 292 is spaced from the seat 305 in the actuator link 118. The flange 310 (FIG. 10) on the spring housing 292 is pressed against the push button 114 (FIG. 12) by the return spring 204.

When the push button 114 is initially moved from its unactuated position, the spring housing 292 moves downward (as viewed in FIG. 10) with the push button relative to the actuator link 118. This downward movement of the spring housing 292 moves the upper collar 304 into engagement with the seat 305 in the recess 307 in the actuator link 118. During this initial movement of the push button 114, the actuator link 118 remains stationary and does not move relative to the sets 210–216 (FIG. 6) of contacts.

As the push button 114 continues to be depressed, the spring housing 292 and actuator link 118 move downward (as viewed in FIGS. 6 and 10) together relative to the sets 210–216 of contacts. As this occurs, the actuator levers 256 in the sets of contacts are pivoted about the upper movable switch contacts 236 (FIG. 9) in the manner previously described.

When the actuator link 118 has been moved downward toward the actuated position for a distance sufficient to move the pivot levers 266 in the sets 210–216 of contacts to an overcenter condition, the actuator lever springs 268 (FIG. 9) in the sets 210–216 (FIG. 6) of contacts move the lower movable switch contacts 240 downward into engagement with the lower stationary switch contacts 232 with a snap action. As this occurs, the actuator link 118 is moved downward (as viewed in FIG. 10) along the spring housing 292 and into engagement with the lower collar 296. At this time, the contacts in the sets 210–216 of contacts are in an actuated condition.

Continued downward movement of the push button 114 is effective to move the spring housing 292 downward while the actuator link 118 remains stationary. This downward movement of the push button 114 moves the upper collar 304 of the spring housing 292 into engagement with the seat 305 (FIG. 10) in the recess 307 in the actuator link 118.

Alternate Action Mechanism

Figure 15:
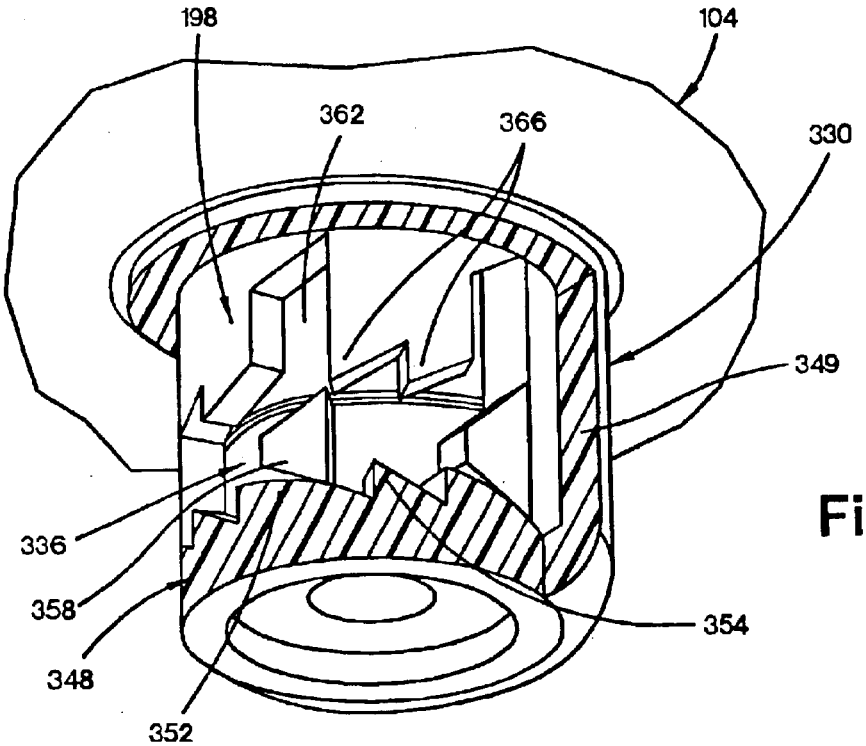
FIG. 15 is an enlarged, partially broken away, schematic pictorial illustration depicting the relationship between the index cam of FIG. 14 and the rotor and alternate action cam assembly of FIG. 13 when installed in the switch assembly.
Figure 23:
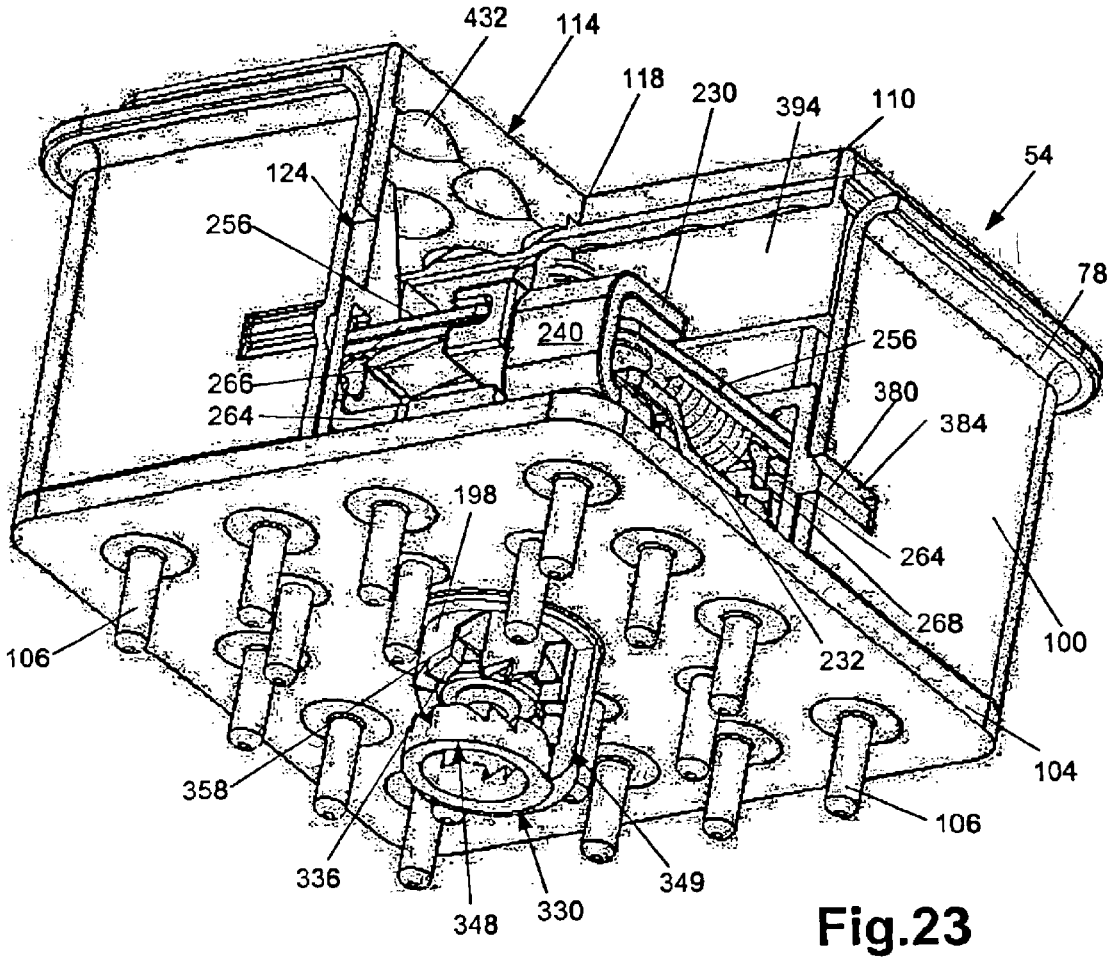
FIG. 23 is a partially broken away bottom schematic pictorial illustration of the switch assembly of FIG. 22 depicting the relationship between the alternate action cam assembly, rotor, and index cam when the switch assembly is in the initial or unactuated condition.

The switch assembly 54 is of the alternate action type. Therefore, the switch assembly 54 includes an alternate action mechanism 330 (FIGS. 15 and 23). The alternate action mechanism 330 is effective to maintain the switch assembly 54 in an unactuated condition until the push button 114 is depressed. Upon manual depression of the push button 114, the alternate action mechanism 330 is effective to latch the switch assembly 54 in an actuated condition until the push button 114 is again manually depressed.

Although the switch assembly 54 is of the alternate action type, It is contemplated that the switch assembly may be of the momentary action type. If the switch assembly 54 is to be of the momentary action type rather than the alternate action type, the alternate action mechanism 330 may be partially or even totally eliminated. This would result in the switch assembly 54 being actuated only during a time period in which the push button 114 is manually held in a depressed condition.

Figure 12:
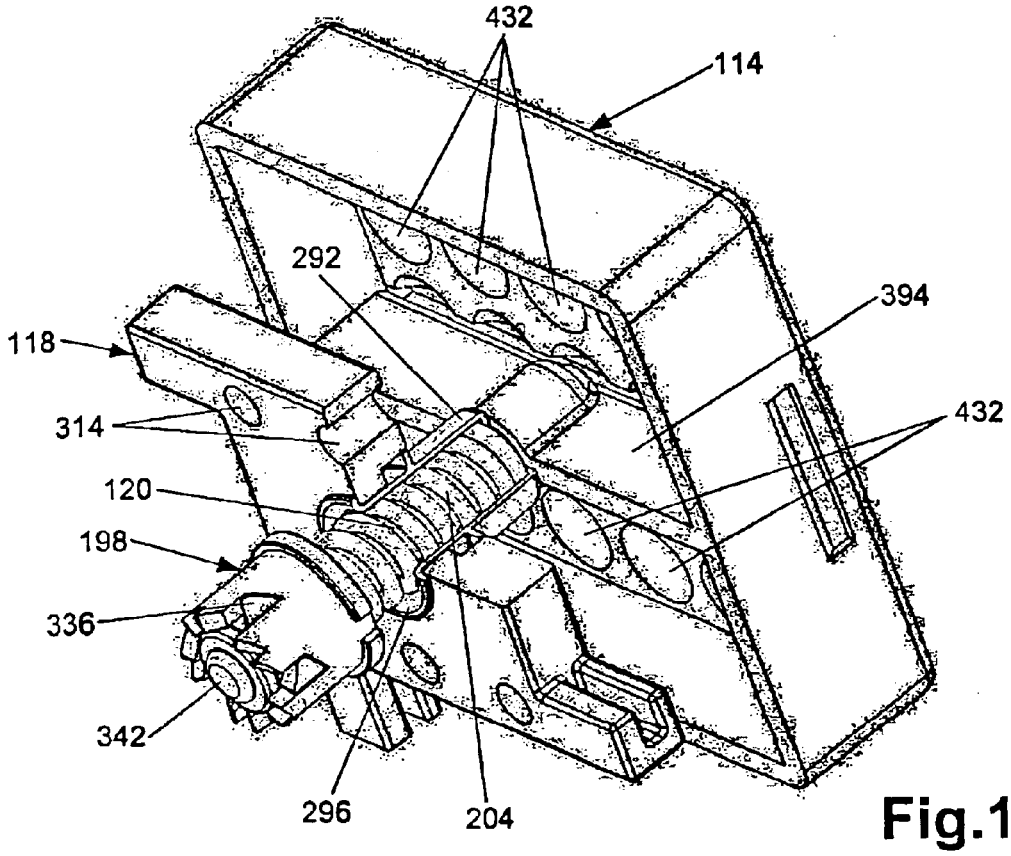
FIG. 12 is a partially broken away, schematic fragmentary pictorial illustration further depicting the relationship between the components illustrated in FIG. 11.
Figure 13:
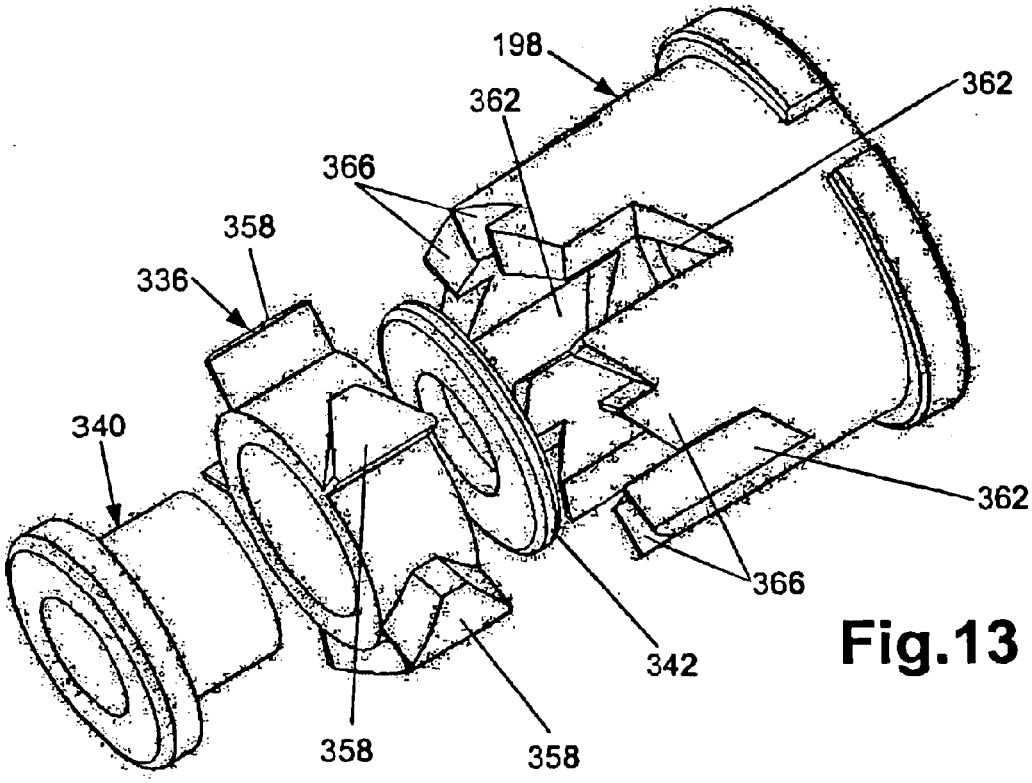
FIG. 13 is a schematic pictorial illustration depicting the construction of a rotor and the alternate action cam assembly used in the switch assembly of FIGS. 3–5.
Figure 14:
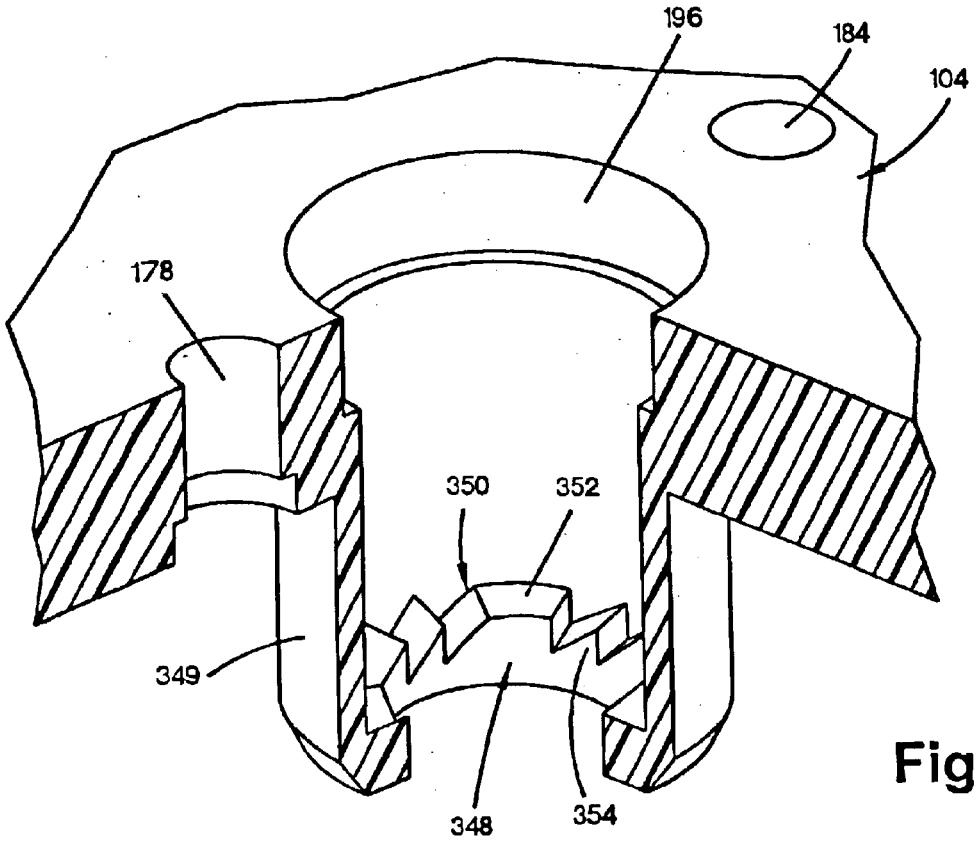
FIG. 14 is an enlarged, partially broken away, schematic pictorial illustration depicting the relationship between the base of FIGS. 7 and 8 and an index cam which cooperates with the rotor and the alternate action cam assembly of FIG. 13.

The alternate action mechanism 330 includes the alternate action cam assembly 198 (FIGS. 12, 13, and 15). The alternate action cam assembly 198 is fixedly connected with the base 104 (FIGS. 7, 14 and 15). The shaft 120 (FIG. 11) is freely movable in an axial direction relative to the alternate action cam assembly 198.

The alternate action mechanism 330 (FIGS. 15 and 23) includes a rotor 336 (FIGS. 12 and 13). The rotor 336 is telescopically mounted on a bushing 340 (FIG. 13). A thrust washer 242 engages in an upper (as viewed in FIG. 13) end of the bushing 340. The rotor 336 can freely rotate relative to the bushing 340 and the shaft 120. The bushing 340 is held on the shaft 120 by forming the shaft with a relatively large head end portion 342 (FIG. 12) which is plastically deformed to hold the bushing 340 in place on the metal shaft 120.

In addition to the alternate action cam assembly 198 and rotor 336, the alternate action mechanism 330 (FIGS. 15 and 23) includes an index cam 348 (FIGS. 14 and 15). The index cam 348 is integrally formed as one piece with a cylindrical tubular housing 349 which extends axially downward (as viewed in FIGS. 5 and 14) from the base 104. The housing 349 and cam 348 form part of the alternate action mechanism 330. The housing 349 and cam 348 are both integrally formed as one piece with the base 104. However, if desired, the housing 350 and/or index cam 348 may be formed separately from the base 104 (FIG. 14) and connected with the base.

The index cam 348 (FIG. 14) includes an array 350 of teeth. The array 350 of teeth includes a plurality of relatively large teeth 352 and a plurality of relatively small teeth 354. The index cam 348 is disposed in a coaxial relationship with the alternate action cam assembly 198 (FIG. 15).

The rotor 336 has a circular array of generally triangular shaped teeth 358 (FIGS. 13 and 15). The rotor teeth 358 engage slots 362 (FIG. 13) in the alternate action cam assembly 198 when the switch assembly 54 is in the unactuated condition. When the switch assembly 54 is being held in the latched or actuated condition, the rotor teeth 358 engage relatively small latching or retaining teeth 366 (FIG. 13) in the alternate action cam assembly 198 to hold the switch assembly 54 in the actuated condition.

The index cam 348 (FIG. 15) cooperates with the rotor 336 and the alternate action cam assembly 198 to align the rotor teeth 358 with either the slot 362 or the teeth 366 of the alternate action cam assembly. The general manner in which the rotor 336 cooperates with the index cam 348 and alternate action cam assembly 198 to hold the switch assembly 54 in the actuated condition or to release the switch assembly from movement to the unactuated condition is the same as is described in the aforementioned U.S. Pat. No. 6,153,841. The disclosure in the aforementioned U.S. Pat. No. 6,153,841 has been and hereby is incorporated herein in its entirety.

Light Module

Figure 22:
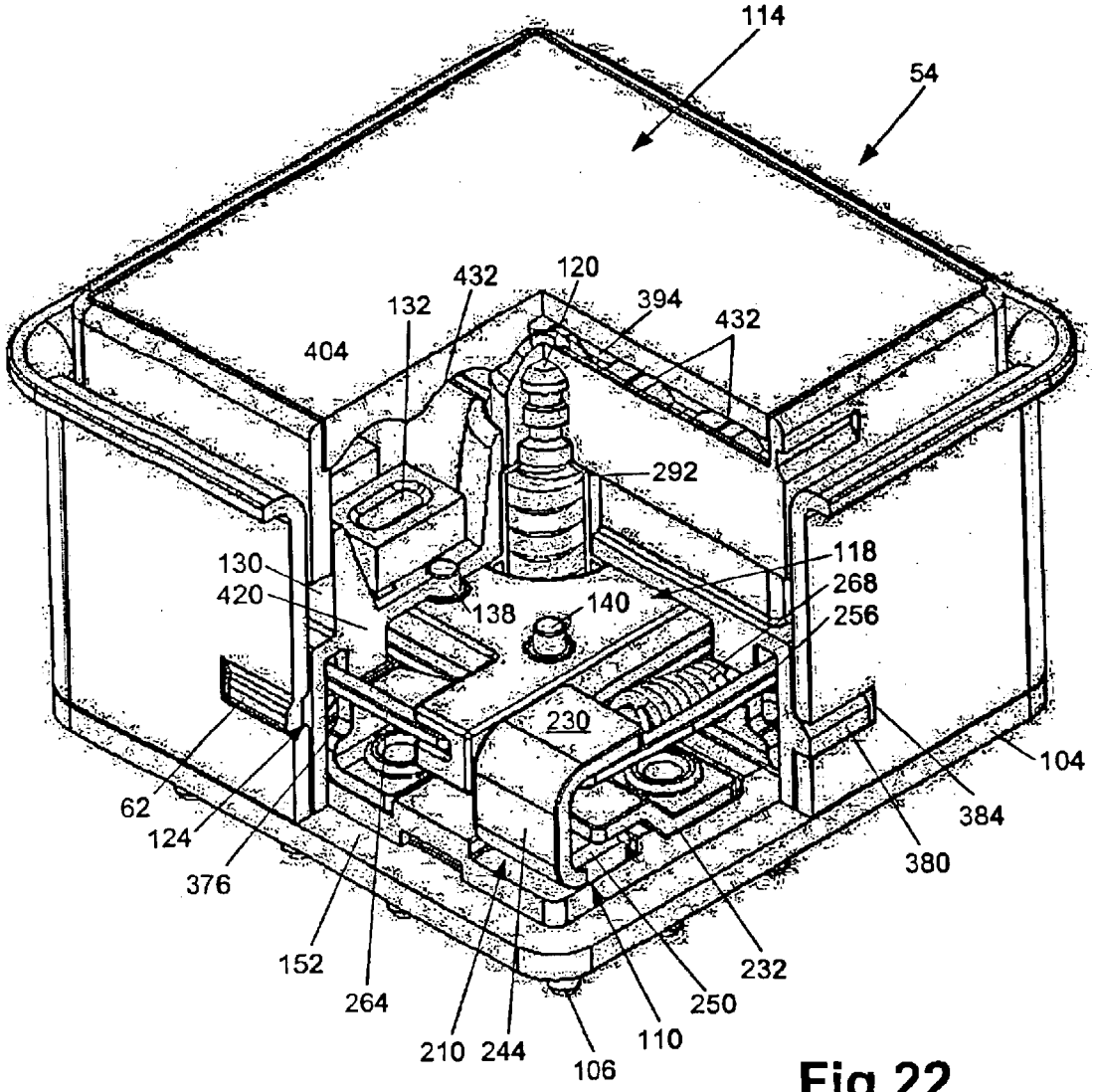
FIG. 22 is a partially broken away schematic pictorial illustration of the switch assembly of FIGS. 3–5 in an initial or unactuated condition.

A light module 372 (FIGS. 16, 17 and 18) includes the light module housing 124. The light module housing 124 has a relatively large rectangular lower portion 376 (FIGS. 17 and 18) which is disposed in a coaxial relationship with the rectangular upper portion 130 (FIG. 16) of the light module housing 124. The rectangular lower portion 376 of the light module housing 124 engages the base 104 (FIG. 22) and encloses the switch contact assembly 110. A square bottom surface area 376 (FIG. 18) on the lower portion 376 of the light module housing 124 engages an upper side of the rim 152 of the base 104 (FIG. 22). The light module housing 124 is integrally formed as a single piece of opaque polymeric material which is electrically insulating.

Figure 16:
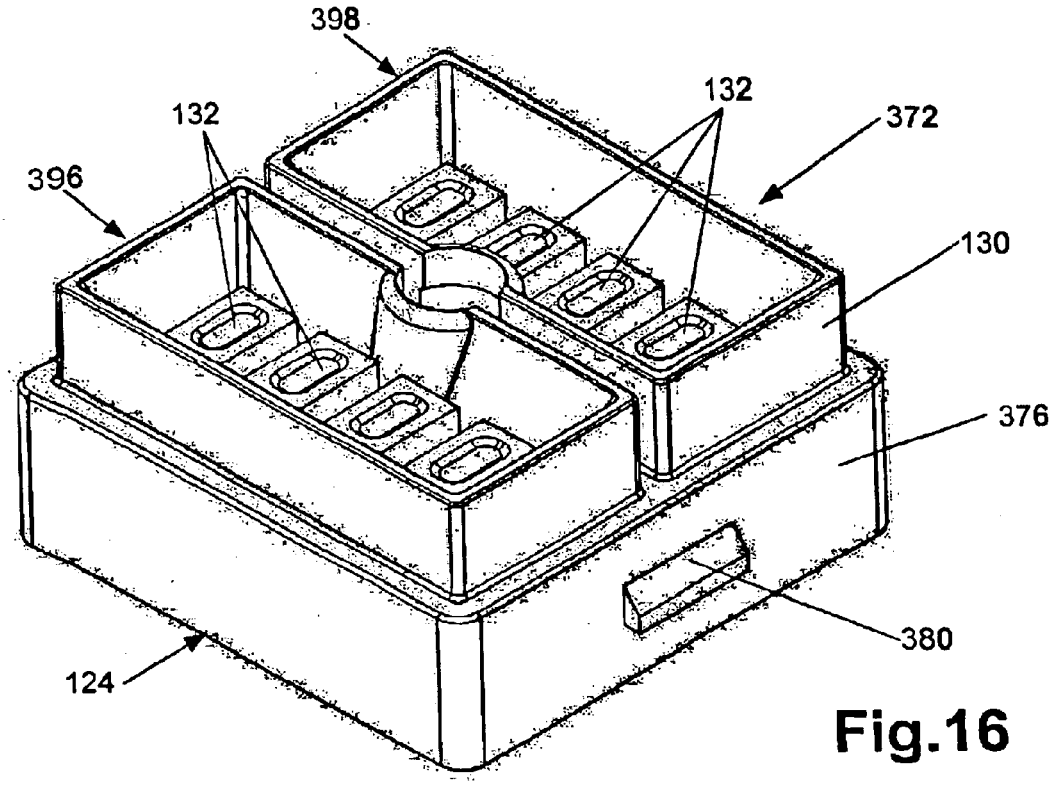
FIG. 16 is an enlarged schematic pictorial illustration depicting the construction of a light module housing utilized in the switch assembly of FIGS. 3–5.
Figure 17:
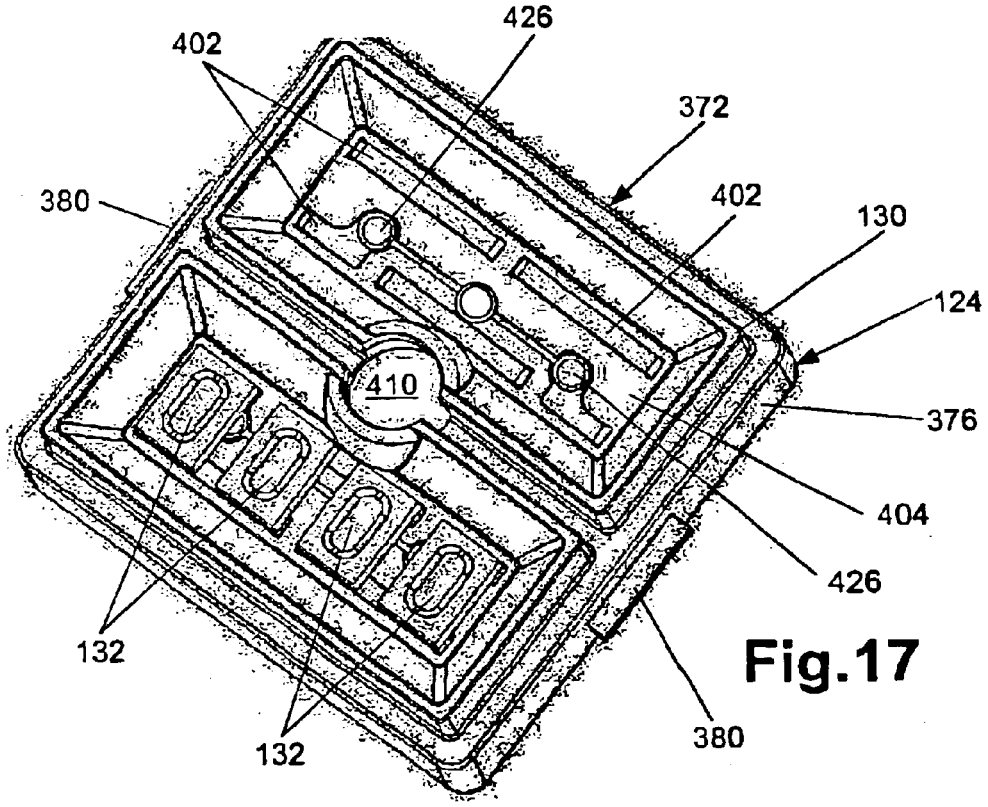
FIG. 17 is a top plan schematic pictorial illustration of the light module housing of FIG. 16 with some light sources removed to expose bus bars in the light module housing.
Figure 18:
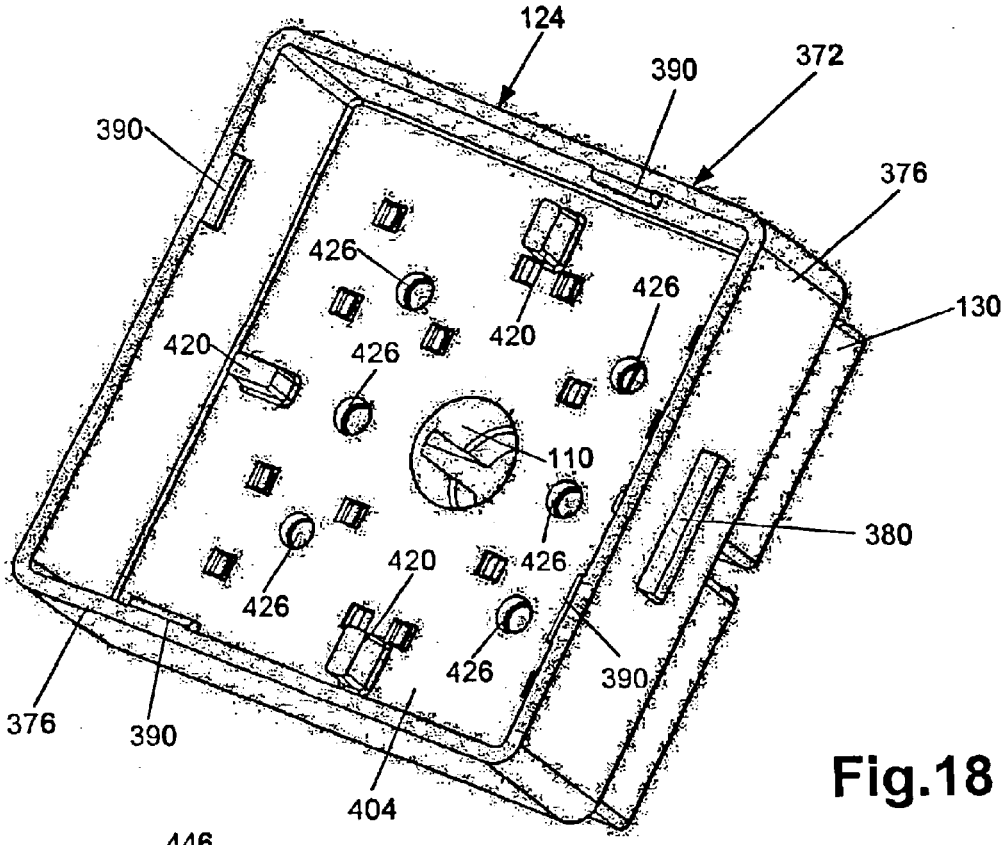
FIG. 18 is a schematic pictorial illustration of the lower side of the light module housing of FIGS. 16 and 17.

The lower portion 376 of the light module housing 124 has a pair of identical retainers 380 (FIG. 16) disposed on opposite sides of the lower portion 376 of the light module housing 124. Although only a single retainer 380 is illustrated in FIGS. 16 and 18 of the drawings, it should be understood that there are a pair of identical retainers on opposite sides of the light module housing 124. The retainers 380 snap into identical openings 384 (FIG. 5) on opposite sides of the switch housing 100. The retainers 380 interconnect the switch housing 100 and the light module housing 124.

The light module housing 124 is connected to the base 104 by projections or retainers 390 (FIG. 18) which project inward from the side walls of the light module housing in the manner illustrated in FIG. 18. The retainers 390 engage openings 392 (FIGS. 7 and 8) formed in the base adjacent to the rim 152.

When the retainers 390 (FIG. 18) on the light module housing 124 have been snapped into the openings 392, the light module housing is fixedly secured to the base 104. The retainers 380 (FIG. 16) on the light module housing 124 engage the openings 384 (FIG. 5) in the switch housing 100 to interconnect the light module housing 124 and the switch housing 100. Therefore, the base 104 and switch housing 100 are interconnected by the light module housing 124. This results in the base 104 being held in engagement with the lower end of the switch housing 100 in the manner illustrated in FIG. 22.

Figure 25:
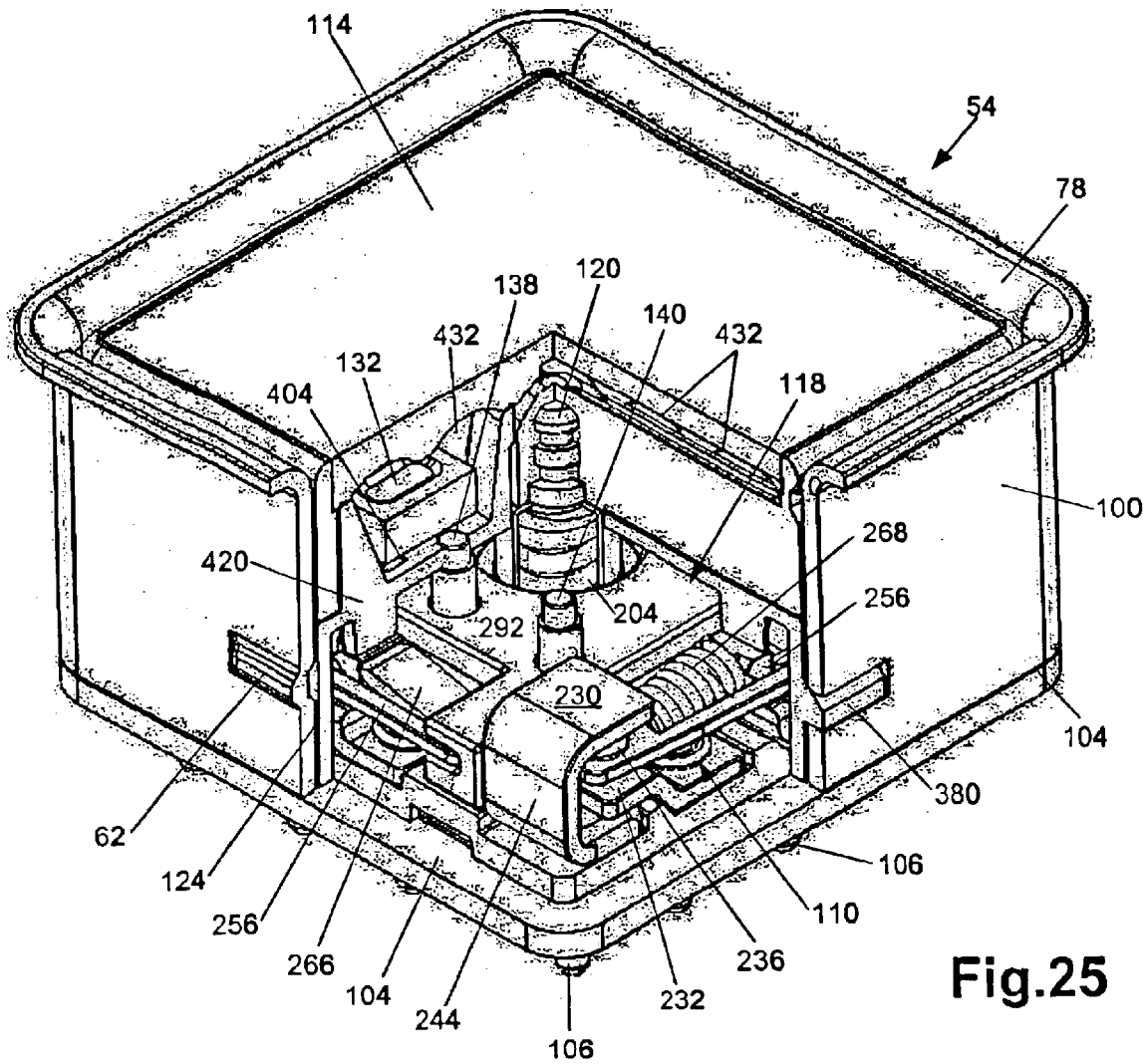
FIG. 25 is a partially broken away schematic pictorial illustration, similar to FIG. 22, of the switch assembly in an actuated condition with the contacts transferred.

The upper portion 130 of the light module housing 124 (FIGS. 16 and 17) is divided into two separate sections 396 and 398 by opaque side walls of the light module housing 124. An opaque cross panel 394 (FIGS. 11 and 12) on the push button 114 is movable into the space between the sections 396 and 398 (FIG. 17) of the light module housing 124. This enables force to be transmitted from the push button 114 to the spring housing 292 as the push button 114 is depressed from the unactuated condition of FIG. 22 to the actuated condition of FIG. 25. The force transmitted from the push button 114 to the spring housing 292 compresses the return spring 204 between the spring housing and the alternate action cam assembly 198 (FIG. 25).

A plurality of light sources 132 (FIG. 16) are disposed in the light module housing 124 on busses or conductors 402. The busses or conductors 402 are disposed on an opaque divider panel 404 (FIGS. 17 and 18) of the light module housing 124. It should be understood that the entire light module housing 124 is integrally molded as one piece of opaque electrically insulating polymeric material.

The light module housing 124 has a central passage 410 (FIGS. 17 and 18) through which the shaft 120 (FIGS. 11 and 22) extends. The spring housing 292 (FIG. 10) extends into the central passage 410 in the light module housing 124 (see FIG. 22).

In addition to enclosing the switch contact assembly 110 and the light sources 132, the light module housing 124 holds the pivot post 264 in position relative to the base 104. The light module housing 124 is provided with a plurality of projections 420 (FIG. 18) which engage the pivot post 264 (FIG. 9) in the sets 210–216 of contacts. The projections 420 hold the pivot posts 264 in position relative to the base 104 in the manner illustrated in FIG. 22. In addition to positioning the pivot posts 264 relative to the base 104, the projections 420 position the light module housing 124 relative to the switch contact assemblies 210–216.

The oonductors 136–146 (FIG. 6) extend through openings 426 (FIGS. 17 and 18) in the divider panel 404 of the light module housing 124. The. conductors 136–146 are effective to electrically connect the busses 402 on the divider panel 404 (FIG. 17) of the light module housing 124 with switch terminals 106. The light from the light sources 132 is directed upward (as viewed in FIGS. 16 and 22) toward the push button 114 (FIG. 22) when the light sources are energized. The light sources 132 may be energized in response to actuation of the switch assembly 54 or in response to a change in conditions remote from the control apparatus 40.

Light dispersion features 432 (FIG. 11) are provided in the push button 114 to disperse the light from the light sources 132. The light dispersion features 432 facilitate reading of indica on the push button in bright sunlight. The light dispersion features are effective to disperse light so that it is transmitted at a plurality of angles to an individual viewing the push button 114.

The light dispersion features 432 may have any one of many known constructions, including the constructions disclosed in U.S. Pat. Nos. 5,295,050; 5,544,019; 5,820,246; and/or 5,951,150. The specific construction of the light dispersion features will depend upon the environment in which the switch assembly 54 is to be used.

Connector Terminal Mounting Block

Figure 21:
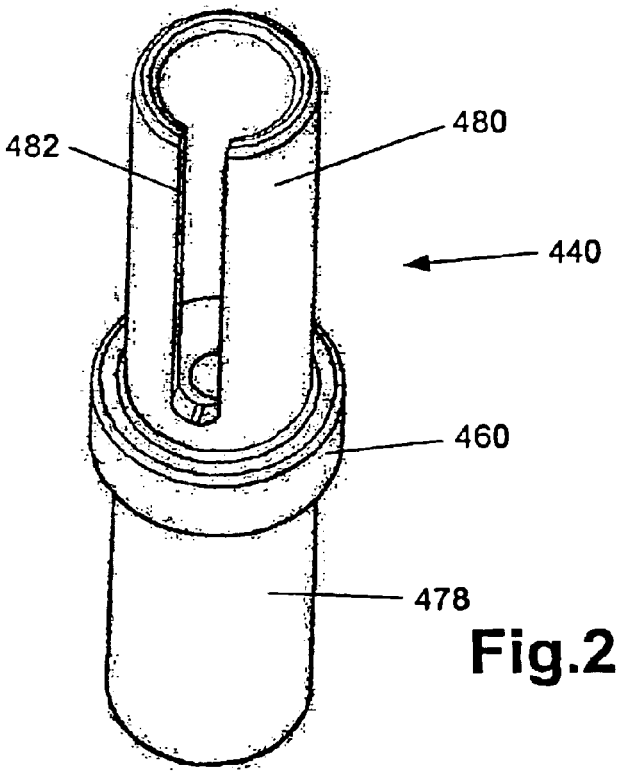
FIG. 21 (on Sheet 9 of drawings) is a schematic pictorial illustration of a connector terminal utilized in association with the connector terminal mounting block of FIGS. 19 and 20.
Figure 19:
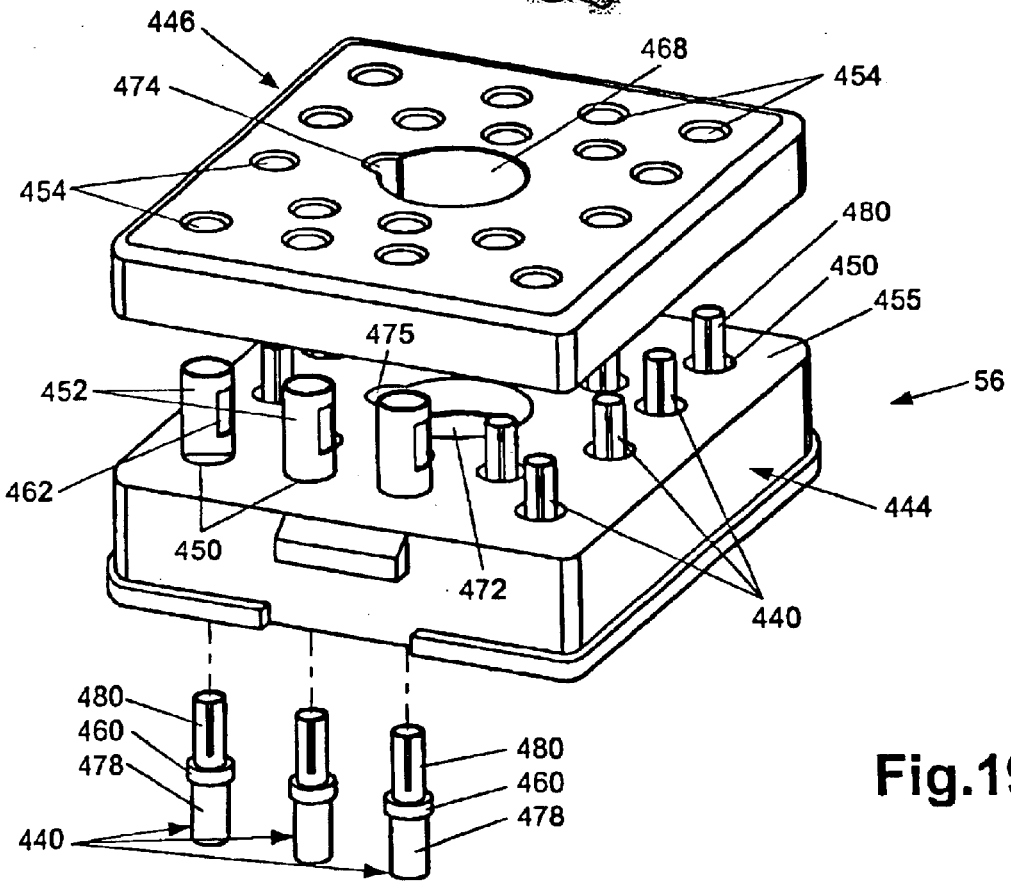
FIG. 19 is an enlarged, partially exploded schematic pictorial illustration depicting the construction of the connector terminal mounting block of FIG. 3.
Figure 20:
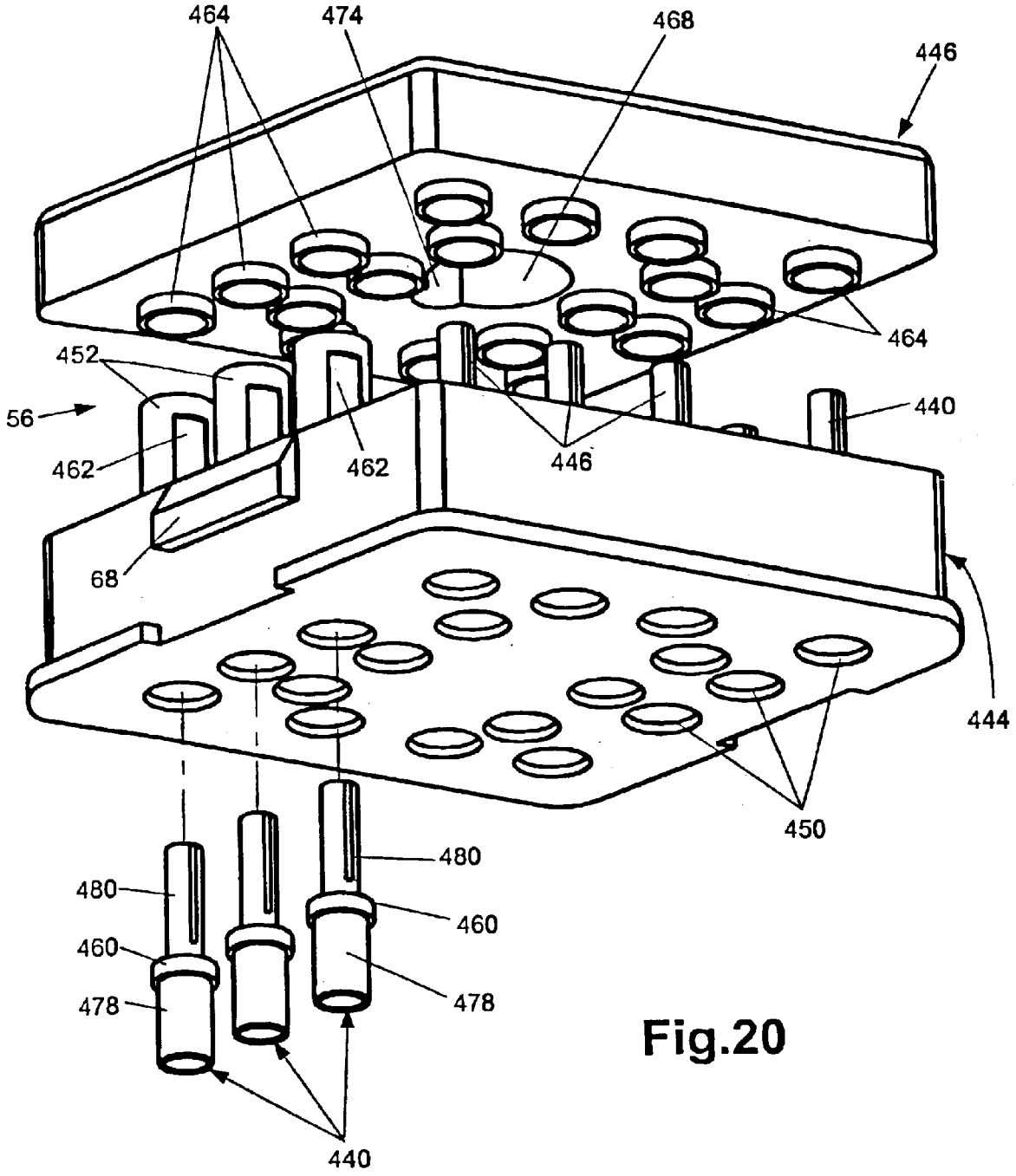
FIG. 20 is a partially exploded schematic pictorial illustration of the lower side of the connector terminal mounting block of FIG. 19.

The connector terminal mounting block 56 (FIGS. 2 and 3) contains connector terminals 440 (FIGS. 19, 20 and 21). The cylindrical metal connector terminals 440 connect the switch terminals 106 (FIGS. 4 and 5) with electrical wires or conductors 82 (FIG. 2). The connector terminals 440 have central axes which extend parallel to the central axes of the switch terminals 106 and the central axis of the push button shaft 120.

The rectangular connector terminal mounting block 56 is formed in two sections, that is a base section 444 (FIGS. 19 and 20) and an intermediate section 446. The intermediate section 446 is disposed between the base section 444 and the switch assembly 54 (FIG. 3). The base section 444 and intermediate section 446 are fixedly interconnected to form a unitary connector terminal mounting block 56 (FIG. 3).

The base section 444 (FIGS. 19 and 20) includes a plurality of cylindrical open ended sockets or openings 450 disposed in an array having a configuration which corresponds to the configuration of the array of switch terminals 106 (FIG. 5). Similarly, the intermediate section 446 of the connector terminal mounting block has a plurality of openings 454 which are aligned with the sockets 450 in the base section 444 of the connector terminal block 56. The base section 444 and intermediate section 446 are formed of an electrically insulating polymeric material.

A contact retainer 452 is provided in each of the sockets 450 in the base section 444. The contact retainers 452 are moved axially downward, as viewed in FIGS. 19 and 20, into the sockets 450. Annular lower (as viewed in FIGS. 19 and 20) ends of the contact retainers 452 engage annular seats or locating surfaces in the sockets 450 to position the contact retainers in the base section 444. When the lower ends of the contact retainers 452 engage the annular locating surfaces in the sockets 450, upper ends of the contact retainers are disposed inward (downward) from a flat upper side surface 455 (FIG. 19) of the base section 444.

Each of the metal terminals 440 (FIG. 21) is telescopically inserted into one of the one of the sockets 450 and the contact retainer 452 in the socket. Each of the metal terminals 440 has an annular rim or locating band 460. The locating band 460 engages a retaining finger 462 formed in a contact retainer 452 to position the connector terminal 440 relative to the base section 444. The retaining finger 462 extends radially inward from a side of the contact retainer 452 at a location between opposite ends of contact retainer.

The intermediate section 446 of the connector terminal block 56 (FIG. 20) is provided with a plurality of annular projections or collars 464 which extend into the sockets 450 (FIG. 19) in the base section 444. Each of the annular projections 264 engages an upper end of a contact retainer 452 to press a lower end of the contact retainer firmly against a locating seat in a socket 450. Although only a few connector terminals 440 and contact retainers 452 have been illustrated in FIGS. 19 and 20, it should be understood that a connector terminal and contact retainer is provided for each of the sockets 450 in the base section 444. There is a connector terminal 440 for each of the switch terminals 106 (FIG. 5).

Once the connector terminals 440 have been positioned in the sockets 450 in the base section 444, the intermediate section 450 is telescopically moved along the connector terminals 440. The projections or collars 464 enter the sockets 450 and press against the annular upper ends of the contact retainers 452 to press the annular lower ends of the contact retainers against the annular seats in the sockets 450. As this occurs, the base section 444 and the intermediate section 446 of the connector terminal mounting block 56 are bonded together to form a unitary structure.

The intermediate section 446 has a circular central opening 468 (FIG. 19) through which the housing 349 (FIGS. 5 and 14) for the alternate action mechanism 330 (FIGS. 14 and 15) extends. The base section 444 is provided with a circular recess 472 (FIG. 19) which receives a lower (as viewed in FIGS. 14 and 15) end of the housing 349. When the base section 444 and intermediate section 446 have been interconnected to form a unitary connector terminal mounting block 56, the opening 468 and recess 472 are aligned to form a cylindrical opening in the connector terminal mounting block 56.

The opening 468 has a discontinuity or projecting portion 474 (FIG. 19). The recess 472 has a similar discontinuity or projecting portion 475. When the base section 444 and intermediate section 446 are interconnected, the projecting portions 474 and 475 are aligned. Therefore, there is a continuous projection or recess extends from an upper end of the opening 468 to the bottom of the recess 472.

The housing 349 (FIG. 15) for the alternate action mechanism 330 includes a projection 476 (FIG. 5) which has the same configuration as the projecting portions 474 and 475 of the open 468 and recess 478. The alternate action mechanism projection 476 engages the projecting portions 474 and 475 of the opening 468 and recess 472. This is effective to orient the switch assembly 54 relative to the connector terminal mounting block 56.

The recess formed by the opening 468 in the intermediate section 446 and the recess 472 in the base section 444 is close ended to facilitate sealing of the switch assembly 54. However, if desired, the opening 472 may extend through the base section 444. This would result in the housing 349 for the alternate action mechanism 330 being exposed.

If the alternate action mechanism 330 is omitted or is disposed above the base 104, the recess formed by the openings 468 in the intermediate section 446 and the opening 472 in the base section 444 may be omitted from the connector terminal block-56. This-would result in the only openings in the intermediate section 446 being the openings 454 for the switch terminals 106.

The connector terminal mounting block 56 is provided with a pair of retainers 68 which snap into the lower openings 66 (FIG. 3) in the outer housing 50 of the control apparatus 40. Engagement of the retainers 68 with the lower openings 66 in the outer housing 50 secures the connector terminal block 56 in place in the outer housing 50. The switch assembly 54 is secured in place in the outer housing 50 by engagement of the retainer 62 with the upper opening 60. When the switch assembly 54 and connector terminal mounting block 56 are both positioned in the outer housing 50 and are held in place by engagement of the retainers 62 and 68 with the openings 60 and 66, the switch terminals 106 are disposed in telescopic engagement with the end portions 480 (FIG. 21) of the connector terminals 440 disposed in the intermediate section 446 of the connector terminal mounting block 56.

Each of the connector terminals 440 (FIG. 21) includes a hollow cylindrical end portion 478 which is connected with a conductor, such as one of the wires 82 of FIG. 2. In addition, the connector terminal 440 includes an end portion 480 (FIG. 21) which telescopically receives one of the switch terminals 106. The end portion 480 of the connector terminal 440 has a hollow cylindrical configuration. A slot 482 extends axially along the end portion 480 of the connector terminal 440.

When a switch terminal 106 (FIGS. 5 and 9) is telescopically inserted into the end portion 480 (FIG. 21) of the connector terminal 440, the cylindrical end portion 480 is slightly expanded in a radial direction and firmly grips the switch terminal. This results in the establishment of relatively large hoop stresses in the end portion 480 of the connector terminal 440 and secure engagement of the end portion of the connector terminal 440 with the switch terminal 106. Switch Assembly-Operation When the switch assembly 54 is in the initial or unactuated condition of FIGS. 22 and 23, the switch contact assembly 110 is in the unactuated condition. Thus, the identical sets 210, 212, 214, and 216 (FIG. 6) of contacts are all in the unactuated condition illustrated in FIG. 9 for the set 210 of contacts. At this time, the actuator link 118 (FIG. 10) is in a raised position (FIG. 22) adjacent to the bottom panel 404 of the light module housing 124. The actuator link 118 is held in the raised position by force transmitted from the return spring 204 (FIG. 8) through the lower collar 296 (FIG. 10) on the return spring housing 292 to the actuator link.

The altermate action mechanism 330 is in the initial or unactuated condition illustrated in FIG. 23. At this time, the teeth 358 (FIG. 13) on the rotor 336 (FIGS. 13 and 23) are disposed in slots 362 (FIG. 13) formed in the alternate action cam assembly 198, in the manner illustrated in FIG. 23. The force transmitted from the return spring 204 to the push button 114 (FIG. 12) through the return spring housing 292 is effective to press the teeth 358 (FIG. 13) on the rotor 336 against the upper (as viewed in FIG. 15) ends of slots 362.

When the push button 114 is manually moved through an initial portion of its operating stroke, the switch contact assembly 110 remains in the initial or unactuated condition of FIGS. 22 and 23. As the push button 114 is partially depressed, the return spring 204 is compressed and the upper collar 304 (FIG. 10) on the spring housing 292 moves into engagement with the seat 305 on the actuator link 118. In addition, the actuator link 118 will move a short distance away from the bottom panel 404 (FIG. 22) of the light module housing 124. The actuator levers 256 (FIG. 9) will have started to pivot about the movable switch contact 236. However, the pivot lever 266 will not have moved to an overcenter position. Therefore, the switch contacts remain in the unactuated condition illustrated in FIGS. 6 and 9.

Although the switch contact assembly 110 is in its initial or unactuated condition, the teeth 358 on the rotor 336 will have started to move out of the slots 362 (FIGS. 13, 15, and 24) in the alternate action cam assembly 198. The teeth 358 on the rotor 336 will have moved downward (as viewed in FIGS. 15 and 24) toward engagement with the index cam 348.

Figure 24:
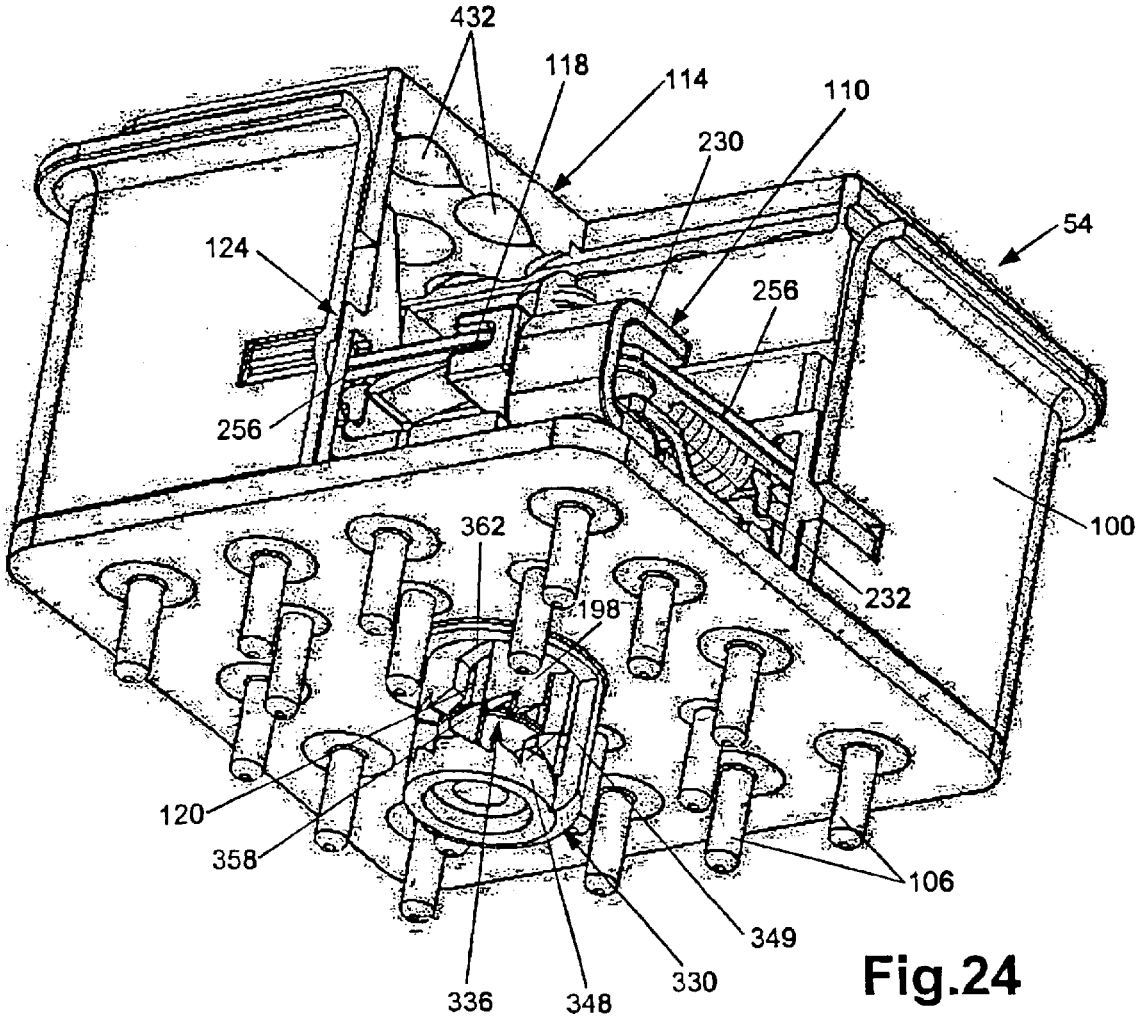
FIG. 24 is a partially broken away bottom schematic pictorial illustration, similar to FIG. 23, depicting the relationship between the alternate action cam assembly, rotor, and index cam when the switch assembly has been partially actuated and prior to transfer of contacts.

Continued depression of the push button 114 will transmit force through the shaft 120 (FIGS. 11 and 12) to the rotor 336 (FIG. 24). This force will cause the teeth 358 on the rotor 336 to engage and slide along cam surfaces formed by a relatively large teeth 352 (FIG. 15) on the index cam 348 (FIG. 24). As this occurs, the rotor 336 rotates relative to the index cam 348 and the alternate action cam assembly 198. The spring housing 292 (FIG. 10) is moved downward by force transmitted from the push button 114. This compresses the return spring 204 (FIG. 12) against the alternate action cam assembly 198.

As the push button 114 is further depressed and the teeth 358 on the rotor 336 slide along the teeth on the index cam 348, the pivot links 266 (FIG. 9) in the sets 210–216 (FIG. 6) of switch contacts move to an overcenter position. As this occurs, the upper movable switch contact 236 (FIGS. 9 and 25) moves away from the upper stationary switch contact 230 with a snap action. This results in the lower movable switch contact 240 (FIG. 9) moving into engagement with the lower stationary switch contact 232 (FIGS. 9 and 25). At this time, the actuator link 118 will have moved away from the bottom panel 404 of the light module housing 124 toward the base 104 of the switch assembly 54 (FIG. 25).

As the switch contact assembly 110 is operated from the unactuated condition to the actuated condition of FIG. 25, at least some of the light sources 132 may be energized with electrical energy conducted from the switch terminals 106 through the conductors 136–146 (FIG. 6). The light from the light sources 132 is dispersed by the light dispersion features 432 to uniformally illuminate at least a portion of the push button 114. The light sources 132 in only one of the sections 396 or 398 of the light module housing 124 may be energized. This will result in only one half of the push button 114 being illuminated.

Figure 26:
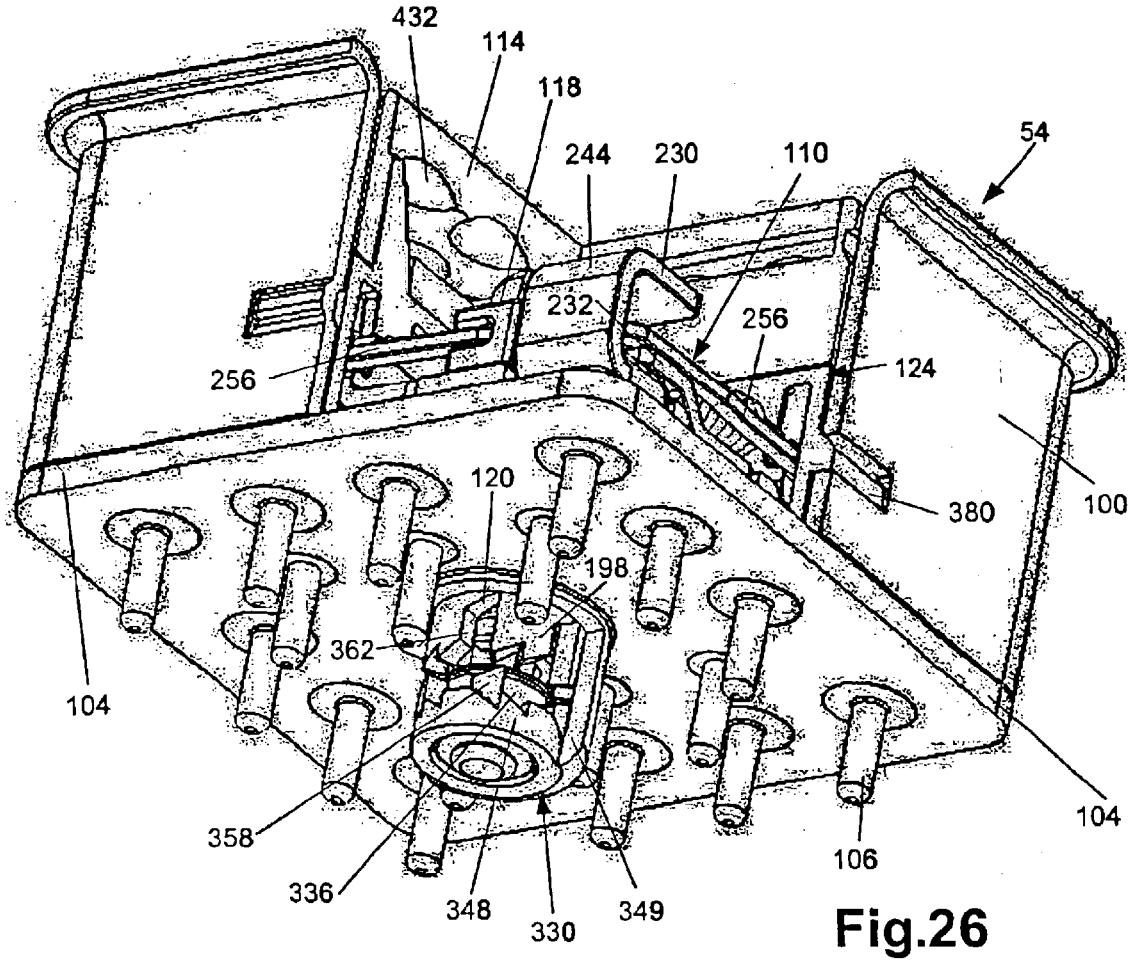
FIG. 26 is a partially broken away bottom schematic pictorial illustration, similar to FIG. 24, depicting the relationship between the alternate action cam assembly, rotor, and index cam when the switch assembly is in the actuated condition.

At this time, the teeth 358 on the rotor 336 will be disposed in engagement with teeth on the index cam 348 (FIG. 26). The teeth 358 on the rotor 356 are spaced from the alternate action cam assembly 198. While the push button 114 is manually held in the depressed condition shown in FIG. 26, the return spring 204 (FIGS. 6, 8 and 25) is applying force to the housing 292 (FIG. 25) urging the push button 114 away from the base 104 of the switch assembly 54. The switch contact assembly 110 is in the actuated condition (FIG. 25).

Figure 27:
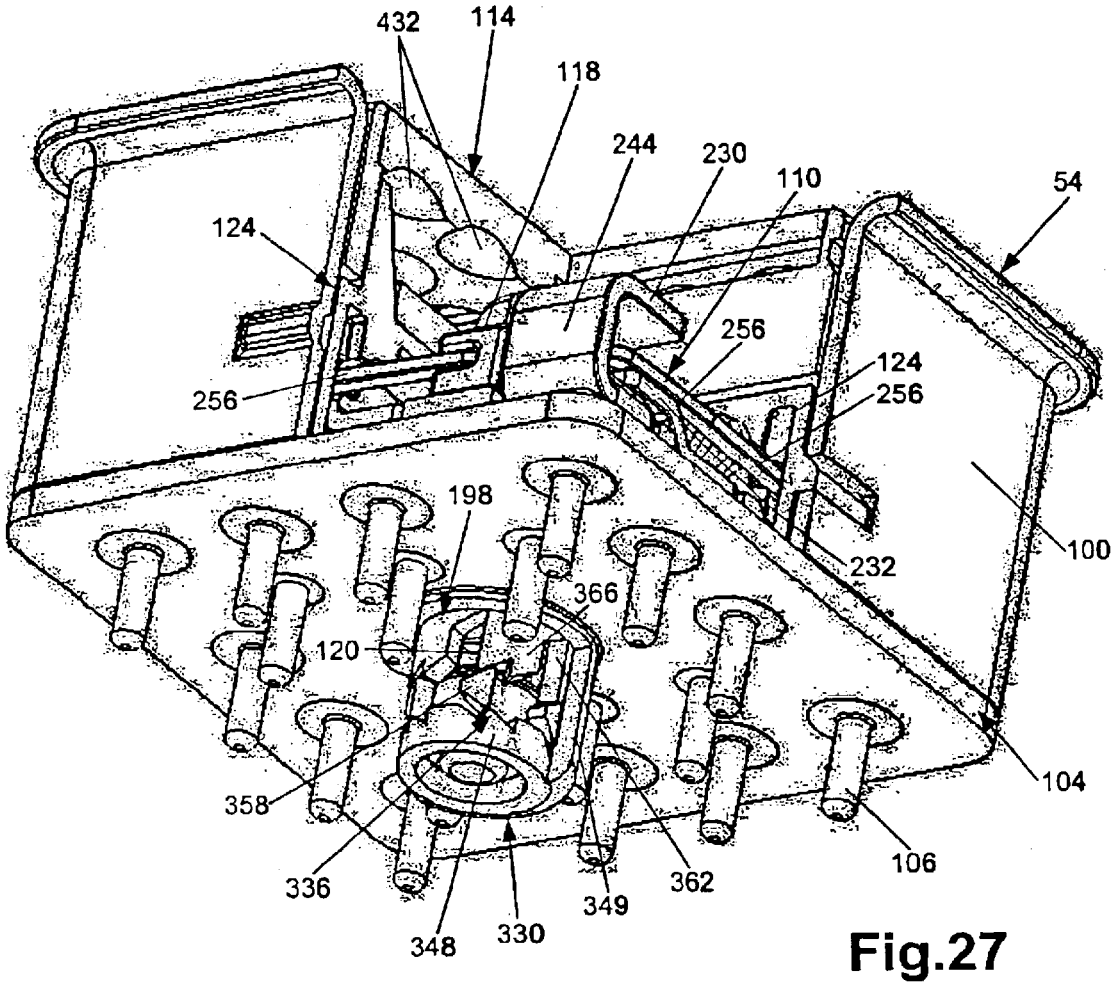
FIG. 27 is a partially broken away bottom schematic pictorial illustration, similar to FIG. 26, depicting the relationship between the alternate action cam assembly, rotor, and index cam when the switch assembly has been released for partial movement toward a latched condition, the switch contacts being in a transferred or actuated condition.

When the push button 114 is manually released, the return spring 204 is effective to move the push button relative to the switch housing 100. As this occurs, the teeth 358 on the rotor 336 move upward (as viewed in FIG. 26) toward the alternate action cam assembly 198 (FIG. 27). Engagement of the teeth 358 on the rotor 336 with teeth 366 (FIG. 13) on the alternate action cam assembly 198 in the manner illustrated schematically in FIG. 27 results in a sliding movement of the rotor teeth on the teeth 366 (FIG. 13) of the alternate action cam assembly 198. At this time, the rotor teeth 358 will have become disengaged from the teeth of the index cam 348.

As the rotor teeth 358 move into engagement with the alternate action cam assembly 198, in the manner illustrated in FIG. 27, the switch contact assembly 110 remains in the actuated condition of FIGS. 25–27. As the push button 114 moves upward, the upper collar 304 (FIG. 10) on the spring housing 292 moves out of engagement with the seat 305 in the actuator link 118 and the lower collar 296 moves into engagement with the lower major side surface 298 of the actuator link. Therefore, the actuator link 118 remains stationary relative to the base 104 of the switch assembly 54 as the alternate action mechanism 330 is operated to the latched condition of FIG. 29.

Figure 28:
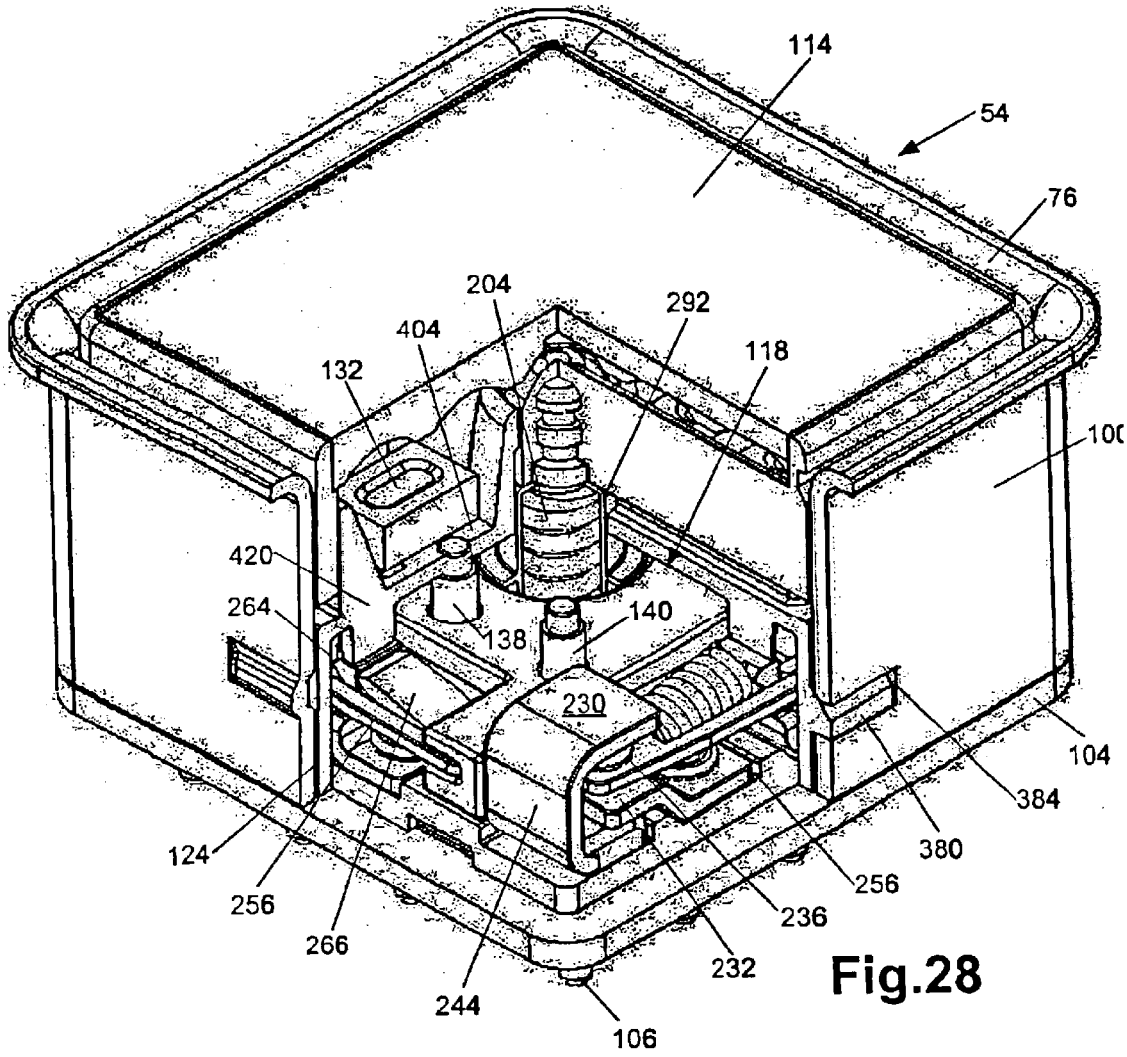
FIG. 28 is a partially broken away schematic pictorial illustration, similar to FIG. 25, of the switch assembly in a latched condition in which the switch contacts are held in the transferred or actuated condition.
Figure 29:
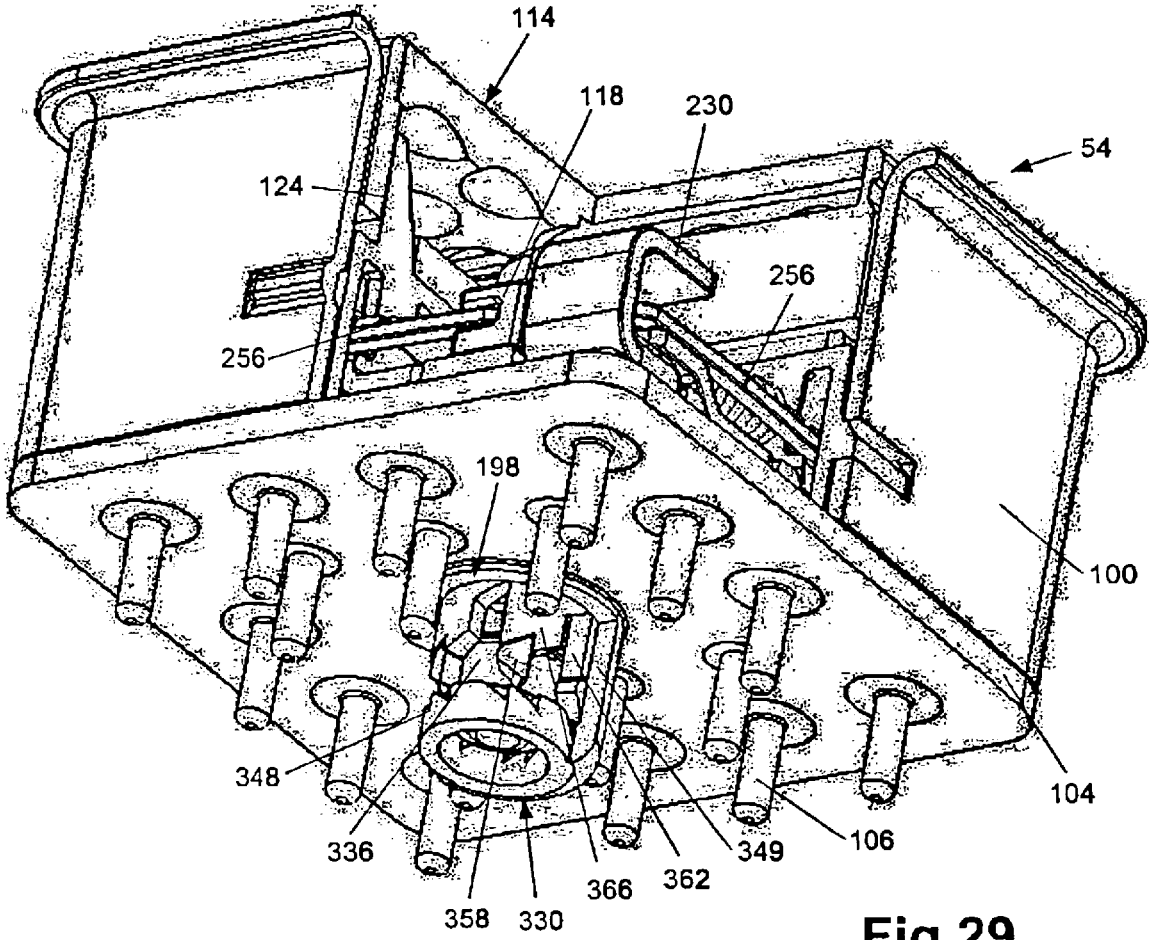
FIG. 29 is a partially broken away bottom schematic pictorial illustration of the switch assembly of FIG. 28 and illustrating the relationship between the alternate action cam assembly, rotor, and index cam when the switch assembly is in the latched condition.

When the alternate action mechanism 330 is in the latched condition of FIG. 29, force transmitted from the rotor 336 through the shaft 120 is effective to hold the push button 114 against movement away from the base 104 under the influence of the return spring 204 even though the push button is completely released. As long as the switch assembly 54 remains in the latched condition of FIGS. 28 and 29, the switch contact assembly 110 remains in the actuated condition with the lower movable switch contacts 240 (FIG. 9) in engagement with the lower stationary switch contacts 232.

Figure 30:
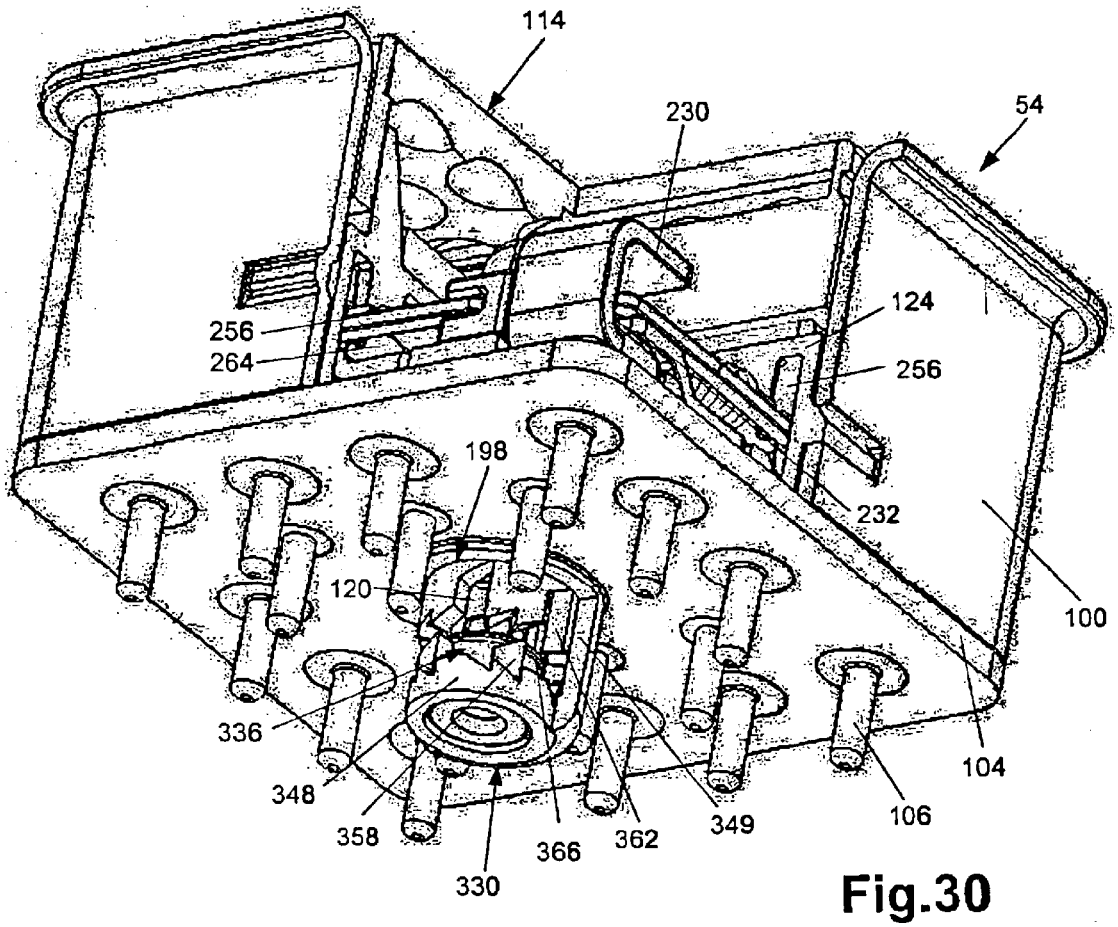
FIG. 30 is a partially broken away bottom schematic pictorial illustration similar to FIG. 29, depicting the relationship between the alternate action cam assembly, rotor, and index cam when the switch assembly has been operated to release the latched condition of FIG. 29.

When the switch assembly 54 is to be operated from the latched condition of FIGS. 28 and 29, the push button 114 is manually depressed to the limit of its travel. As this occurs, the teeth 358 on the rotor 336 move downward (as viewed in FIG. 30) into engagement with the index cam 348. As this occurs, the rotor 336 is rotated relative to the shaft 120 by a cam action between the teeth 358 on the rotor 336 and the teeth on the index cam 348. When the push button 114 is subsequently released, the return spring 204 (FIGS. 6 and 8) moves the push button away from the base 104 of the switch assembly 54. As this occurs, the teeth 358 on the rotor 336 move into engagement with the alternate action cam assembly 198 in the manner illustrated in FIG. 31. At this time, the switch contact assembly 110 is still in the actuated condition.

Figure 31:
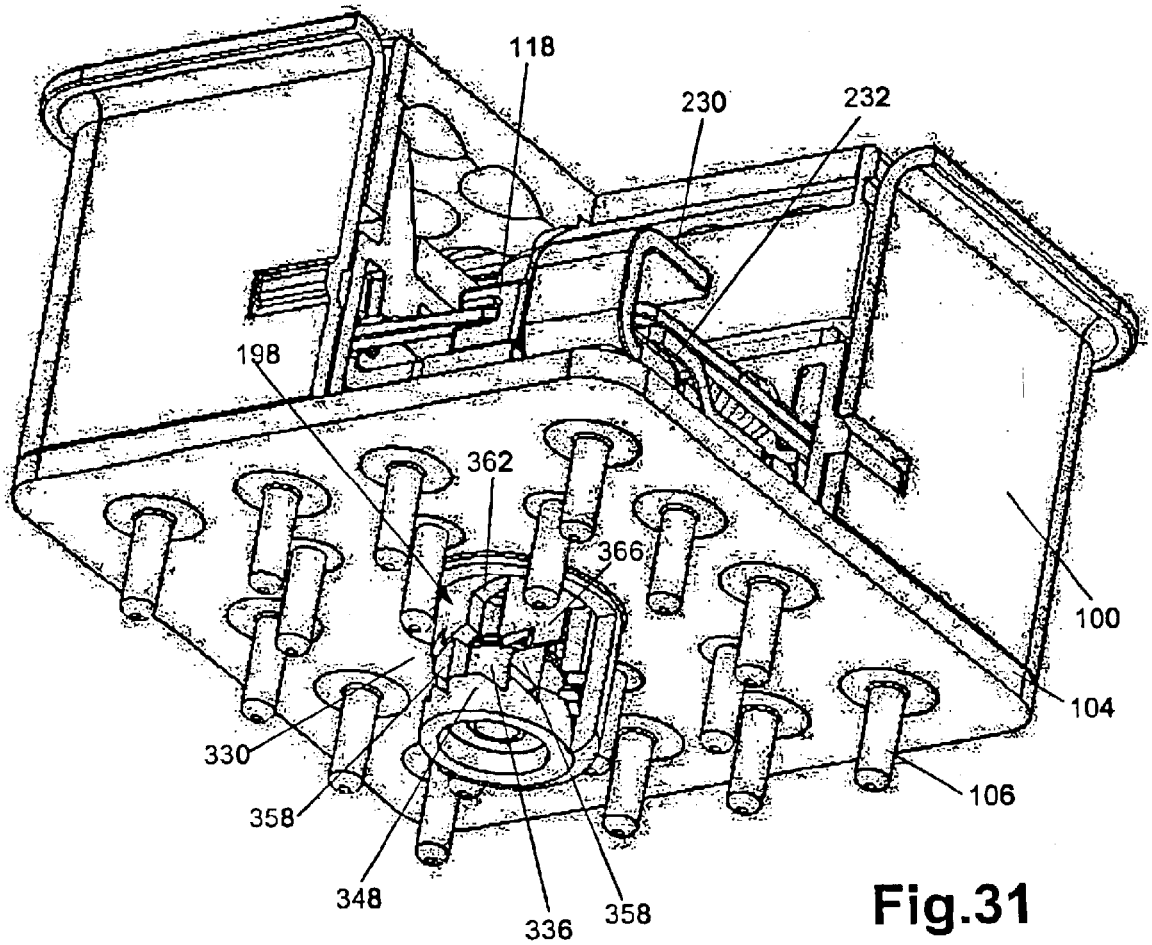
FIG. 31 is a partially broken away bottom schematic pictorial illustration of the switch assembly, similar to FIG. 30, depicting a relationship between the alternate action cam assembly, rotor, and index cam when the switch assembly has operated part way from the actuated condition of FIG. 30 toward the unactuated or initial condition of FIGS. 22 and 23.

The force applied against the spring housing 292 and push button 114 by the return spring 204 continues the outward movement of the push button from the partially actuated position of FIG. 31 back to the unactuated position of FIG. 23. As this occurs, the camming action between the teeth 358 on the rotor 336 and the alternate action cam assembly 198 rotates the rotor 336 relative to the shaft 120. This results in the rotor teeth 358 being moved into alignment with the slots 362 in the alternate action cam assembly 198. As the rotor teeth 358 move into alignment with the slots 362 in the alternate action cam assembly 198, the return spring 204 is effective to move the push button 114 to the unactuated position of FIGS. 22 and 23. As this occurs, the switch contact assembly 110 returns to the unactuated condition with a snap action.

Switch Assembly Circuit Board Mounting

Figure 33:
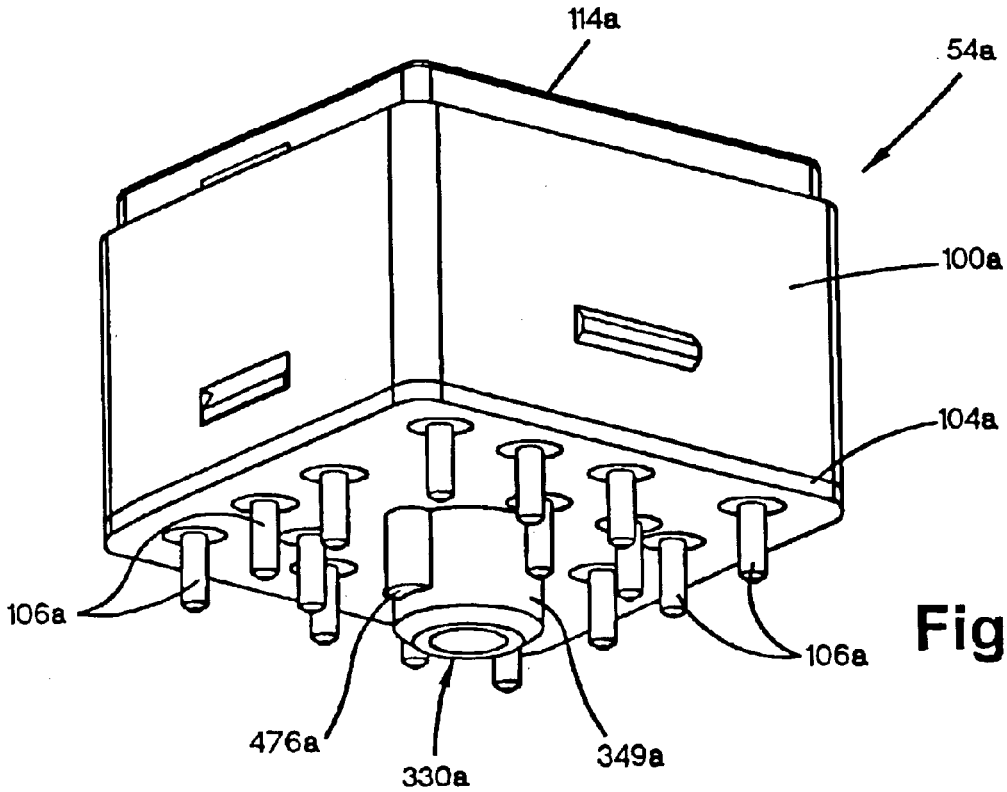
FIG. 33 is a bottom schematic pictorial illustration of the switch assembly of FIG. 32 and depicting the relationship between a base of the switch assembly, a housing for an alternate action mechanism, and a projection from the housing for the alternate action mechanism.
Figure 34:
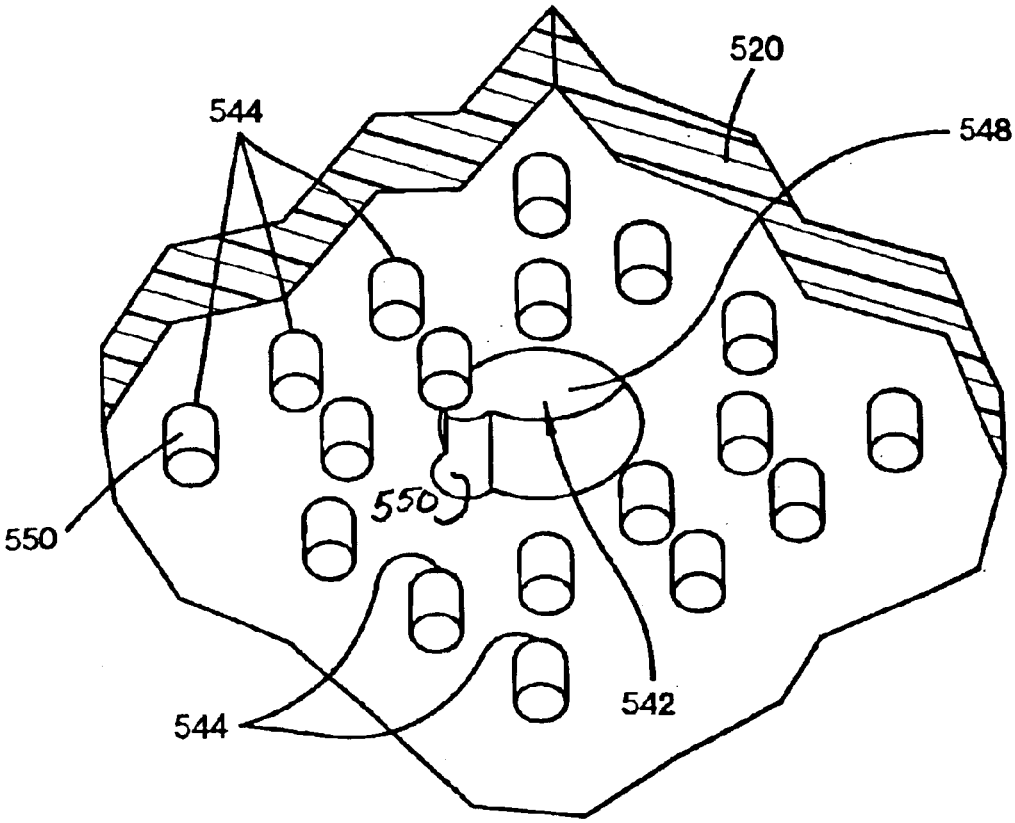
FIG. 34 is an enlarged fragmentary pictorial illustration depicting the relationship of an array of sockets to an opening in the printed circuit board of FIG. 32 and illustrating the relationship of a discontinuity in the opening in the circuit board to the array of sockets.

In the embodiment of the invention illustrated in FIGS. 1 and 2, the switch assembly 54 is connected with a connector terminal mounting block 56 and is disposed in an outer housing 50. The outer housing 50 is connected with a control panel 42 by fasteners 44 and 46. In the embodiment of the invention illustrated in FIGS. 32–34, the connector terminal mounting block 56 and outer housing 50 are omitted. The switch assembly 54 is mounted directly on a printed circuit board. Since the embodiment of the invention illustrated in FIGS. 32–34 is similar to the embodiment of the invention illustrated in FIGS. 1–31, similar numerals will be utilized to designate similar components, the suffix letter "a" being associated with the numerals of FIGS. 31–34 to avoid confusion.

Figure 32:
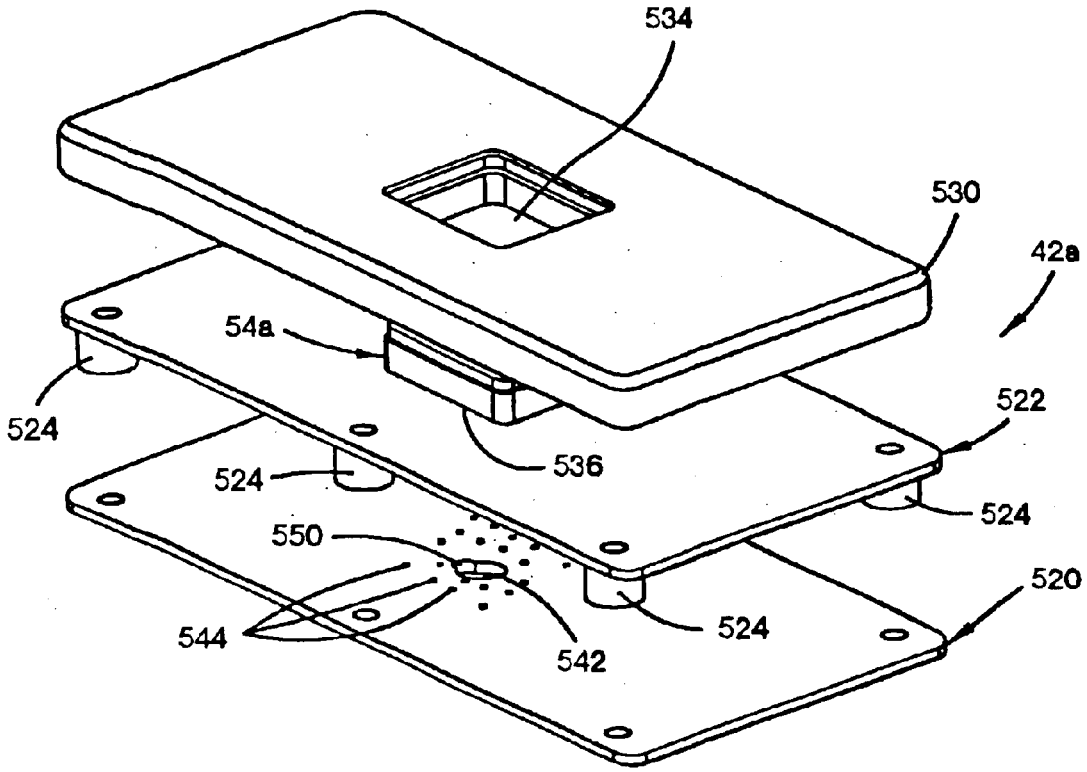
FIG. 32 Is a partially exploded schematic pictorial illustration depicting a relationship of the switch assembly of FIGS. 4 and 5 to a front light panel, mounting panel, and printed circuit board.

A control panel 42a includes a printed circuit board 520 (FIG. 32). A mounting panel 522 is disposed directly above and extends parallel to the printed circuit board 520. Spacers 524 are provided between the printed circuit board 520 and the mounting panel 522. A front light panel 530 is connected with the mounting panel 522 and printed circuit board 520. The light panel 530 is disposed in engagement with the mounting panel 522.

A switch assembly 54*a* is mounted on the control panel 42*a*. The switch assembly 54*a* has the same construction and mode of operation as the switch assembly 54 of FIGS. 1–31. However, the switch assembly 54*a* is mounted directly on the printed circuit board 520. The printed circuit board 520 has printed circuits (not shown) which connect the switch assembly 54*a* with electrical components (not shown) on the printed circuit board 520 and with conductors leading to remote locations.

The switch assembly 54*a* extends through a rectangular opening 534 in the light panel 530 and through a rectangular opening 536 in the mounting panel 522 (FIG. 32). This results in a push button 114*a* (FIG. 33) being exposed through the opening 534 in the light panel 530. The switch assembly 54*a* has a housing 100*a* which engages side surfaces of the opening 534 in the light panel 530 and the opening 536 in the mounting panel 522. Engagement of the housing 100*a* with the side surfaces of the openings 534 and 536 in the light panel 530 and mounting panel 522 is effective to hold the switch assembly against side ways movement relative to the control panel 42*a,* that is, against movement in a direction extending parallel to a major side surface of the printed circuit board 520.

The switch assembly 54*a* includes a base 104*a* (FIG. 33). An array of metal switch terminals 106*a* extends downward (as viewed in FIG. 33) from the base. Parallel longitudinal axes central of the switch terminals 106*a* extend perpendicular to a major lower side surface of the base 104*a*.

In addition to the switch terminals 106*a,* an alternate action mechanism 330*a* extends downward (as viewed in FIG. 33) from the base 104*a*. The alternate action mechanism 330*a* has the same construction as the alternate action mechanism 330 of FIGS. 1–31 and has the same mode of operation as the alternate action mechanism 330. The alternate action mechanism 330*a* includes a cylindrical housing 349*a*. A projection 476*a* has the same construction as the projection 476 of FIG. 5 and extends outward from the housing 349*a*. The projection 476*a* is integrally formed as one piece with the housing 349*a* for the alternate action mechanism 330*a*.

The printed circuit board 520 includes an opening 542 (FIGS. 32 and 34) which extends through the printed circuit board. An array of sockets 544 extends around the opening 542. The opening 542 has a circular central portion 548 (FIG. 34) and a discontinuity or projecting portion 550. The discontinuity 550 is engaged by the projection 476*a* (FIG. 33) from the housing 349*a* of the alternate action mechanism 330*a*. Engagement of the projection 476*a* with the projecting portion 550 (FIG. 34) of the opening 542 orients the switch assembly 54*a* relative to the printed circuit board 520.

The illustrated discontinuity 550 (FIG. 34) has a configuration corresponding to a configuration of a portion of a cylinder having a central axis which is parallel to and offset from the central axis from the opening 542. Although the illustrated discontinuity 550 has an arcuate configuration, it is contemplated that the discontinuity 550 could have a different configuration if desired. For example, the discontinuity 550 may have flat side surfaces and have either a triangular or rectangular configuration. Alternatively, the discontinuity 550 may be formed by a combination of arcuate and linear surfaces. Of course, the projection 476*a* (FIG. 33) from the alternate action mechanism housing 349*a* would have a configuration corresponding to the selected configuration of the discontinuity 550 (FIG. 34).

When the switch assembly 54*a* (FIGS. 32 and 33) is to be mounted on the printed circuit board 520, the mounting panel 522 may have been connected to the printed circuit board. At this time, the light panel 530 may be separate from the mounting panel 522. The opening 536 in the mounting panel 522 (FIG. 32) is aligned with the opening of 542 in the printed circuit board 520. The sockets 544 in the printed circuit board 520 are exposed through the opening 536.

The switch assembly 54*a* is aligned with the opening 536 in the mounting panel 522. As the switch assembly 54*a* is aligned with the opening 536 in the mounting panel 522, the switch assembly is oriented so that the projection 476*a* from the alternate action mechanism housing 349*a* (FIG. 33) is aligned with the discontinuity 550 (FIGS. 32 and 34) projecting from the central portion 548 of the opening 542 in the printed circuit board 520. Aligning the projection 476*a* on the alternate action mechanism housing 349*a* with the discontinuity 550 is effective to align the terminals 106*a* (FIG. 33) on the switch assembly 54*a* with the sockets 544 (FIGS. 32 and 34) on the printed circuit board 520.

Once the switch assembly 54*a* has been aligned with the opening 536 in the mounting panel 522 and the opening 542 in the printed circuit board 520, the switch assembly is moved through the opening 526 in the mounting panel 522. The switch terminals 106*a* move into engagement with the sockets 544 in the printed drcult board 520. At the same time, the alternate action mechanism housing 349*a* moves into the opening 542 in the printed circuit board.

Continued movement of the switch assembly 54*a* toward the printed circuit board 520 moves the switch terminals 106*a* into the sockets 544. In addition, the alternate action mechanism housing 349*a* moves through the opening 542 in the printed circuit board so that the upper side surface of the printed circuit board is disposed in abutting engagement with the base 104*a* on the switch assembly 54*a*. At this time, the projection 476*a* from the alternate action mechanism housing 349*a* will be disposed in the discontinuity 550.

By engaging the discontinuity 550 with the projection 476*a* from the alternate action mechanism housing 349*a*, the indicia on the push button 114*a* is oriented relative to the control panel 42*a*. In addition, the terminals 106*a* are oriented relative to the sockets 544 on the printed circuit board 520. This results in a switch contact assembly in the switch assembly 54*a* being connected in a desired manner with the electrical circuitry on the printed circuit board 520 by the switch terminals 106*a*. The switch contact assembly in the switch assembly 54*a* has the same construction as the switch contact assembly 110 of FIG. 6.

If desired the alternate action mechanism 330*a* (FIG. 33) may be eliminated or enclosed within the switch housing 100*a*. If this is done, the opening 542 (FIGS. 32 and 34) may be eliminated from the printed circuit board 520. If this is done, an extra socket 544 or discontinuity may be provided in the printed circuit board 520 and engaged by a locating pin to orient the switch assembly 54*a* relative to the printed circuit board.

Conclusion

In view of the foregoing description, it is apparent that the present invention provides a new and improved control apparatus 40 which is compact and light weight. The apparatus 40 may include an outer housing 50 which at least partially encloses a switch assembly 54 and a connector terminal mounting block 56. A plurality of connector terminals 440 associated with the connector mounting terminal block 56 may be connected with electrical conductors 82. The switch assembly 54 may be connected with the connector terminals 440.

The switch assembly 54 may include a switch housing, a base 104 which is at least partially enclosed by the switch housing 100, and a plurality of switch terminals 106. A plurality of movable and stationary switch contacts 230, 232, 236 and 240 may be connected with the switch terminals 106. The actuator link 118 may be connected with a push button 114 and the movable switch contacts 236 and 240.

A light module housing 124 may be at least partially enclosed by the switch housing 100. The light module housing 124 may have a first portion 376 in which the movable switch contacts 236 and 240 are at least partially disposed and a second portion 130 in which a plurality of light sources 132 are disposed. The push button 114 may be at least partially illuminated by light from the light sources 132 upon energization of the light sources.

A plurality of conductors 136–146 may be utilized to conduct electrical energy to the light sources 132. These conductors 136–146 may extend through the actuator link 118. Upon movement of the push button 114, the actuator link 118 may be moved relative to the conductors 136–146.

In order to enable the switch contacts to be relatively close to each other, a body 250 of insulating material may be disposed in engagement with a stationary switch contact 232. The body 250 of insulating material may also engage a conductor 244 connected with another stationary switch contact 230 and/or a switch terminal 106. The use of the body 250 of insulating material enables the stationary switch contact 232 to be disposed dose to the conductor 244 and a switch terminal 106.

An alternate action mechanism 330 may be connected with the push button 114. The alternate action mechanism 330 may be disposed in an opening 468, 472 formed in the connector terminal mounting block 56.

The outer housing 50 may be omitted. The switch assembly 54 may be mounted on a printed circuit board 520. If this is done, the switch terminal 106 may extend into sockets 544 in the printed circuit board. The alternate action mechanism 330 may extend into an opening 542 in the printed circuit board 520.

The control apparatus 40 of the present invention includes many different features. It is contemplated that these features may advantageously be utilized together. However, it is also contemplated that each of the features may be used separately or in combination with known features from the prior art. Various combinations of the features of the present invention may be utilized with or without features from the prior art.

Having described the invention, the following is claimed:

1. An apparatus comprising an outer housing, a switch assembly which is at least partially disposed in said outer housing, said switch assembly includes a switch housing having a switch housing locating surface which engages a first locating surface on said outer housing to position said switch assembly relative to said outer housing, said switch assembly includes a plurality of switch terminals which extend from said switch housing, a connector terminal mounting block which is at least partially disposed in said outer housing, said connector terminal mounting block having a connector terminal mounting block locating surface which engages a second locating surface on said outer housing to position said connector terminal block relative to said outer housing, and a plurality of connector terminals which are at least partially disposed in said connector terminal mounting block, each of said connector terminals having a first end portion which engages one of said switch terminals and a second end portion which is connectable with an electrical conductor.

2. An apparatus as set forth in claim 1 wherein said outer housing includes a plurality of side walls which extend between opposite ends of said outer housing, said first locating surface on said outer housing being at least partially disposed on an end of one of said side walls of said outer housing, said second locating surface on said outer housing being at least partially disposed on an end of one of said side walls of said outer housing.

3. An apparatus as set forth in claim 2 further including first and second openings formed in said side walls of said outer housing, said switch housing having a switch housing retainer which snaps into the first opening in said side walls of said outer housing, said connector terminal mounting block having a connector terminal mounting block retainer which snaps into the second opening in said side walls of said outer housing.

4. An apparatus as set forth in claim 1 wherein said switch assembly includes a base, a plurality of stationary switch contacts, and a plurality of movable switch contacts connected with said base, said switch terminals being connected with said base, and a light module housing which at least partially encloses said movable switch contacts, said light module housing having a first light module housing retainer which snaps into an opening in said base to interconnect said light module housing and said base, said light module housing having a second light module housing, retainer which snaps into an opening in said switch housing to interconnect said light module housing and said switch housing, and a plurality of light sources connected with and at least partially enclosed by said light module housing.

5. An apparatus as set forth in claim 4 wherein said switch assembly further includes a push button which is movable relative to said light module housing and said base to move said movable switch contacts relative to said fixed switch contacts and said base, said movable switch contacts being disposed between said base and said push button.

6. An apparatus as set forth in claim 1 wherein said switch assembly includes a base which is connected with and is at least partially enclosed by said switch housing, a plurality of movable and stationary switch contacts disposed in said switch housing, said stationary switch contacts being connected with said base and said switch terminals, said movable switch contacts being movable relative to said base and being connected with said switch terminals, an actuator link connected with said movable switch contacts, and a push button connected with said actuator link, said push button being movable relative to said base to move said actuator link and said movable switch contacts relative to said base and said stationary switch contacts, said movable switch contacts and said actuator link being disposed between said base and said push button, said base being disposed between said connector terminal mounting block and said push button.

7. An apparatus as set forth in claim 1 wherein said switch housing includes a rim which extends around said switch housing, said switch housing locating surface being disposed on said rim of said switch housing, said connector terminal mounting block includes a rim which extends around said connector terminal mounting block, said connector terminal mounting block housing locating surface being disposed on said rim of said connector terminal block.

8. An apparatus as set forth in claim 1 wherein said switch assembly includes a plurality of stationary switch contacts and a plurality of movable switch contacts, and an alternate action mechanism which is operable to maintain said movable switch contacts in an actuated condition in response to a first manual actuation of said push button and to release said movable switch contacts in response to a second manual actuation of said push button, said alternate action mechanism being at least partially disposed in an opening formed in said connector terminal mounting block.

9. An apparatus as set forth in claim 8 wherein said connector terminal mounting block includes a first section which is fixedly connected with a second section of said connector terminal mounting block, said alternate action mechanism extends through an opening in said first section of said connector terminal mounting block into a recess in said second section of said connector terminal mounting block.

10. An apparatus as set forth in claim 9 wherein said second section of said connector terminal mounting block includes a plurality of openings which extend through said second section of said connector terminal mounting block, each of said openings in said second section of said connector terminal mounting block contains a locating surface disposed between first and second sides of said second section of said connector terminal mounting block, each of said connector terminals being at least partially disposed in one of said openings in said second section of said connector terminal mounting block and being disposed in engagement with a locating surface disposed in said one of said openings in said connector terminal mounting block, said first section of said connector terminal mounting block includes a plurality of openings which extend through said first section of said connector terminal mounting block, said first section of said connector terminal mounting block includes a plurality of collars each of which extends around an entrance to one of said openings in said first section of said connector terminal mounting block and extends into one of said openings in said second section of said connector terminal mounting block, each of said connector terminals extends through one of said collars into said first section of said connector terminal mounting block.

11. An apparatus as set forth in claim 1 wherein said switch assembly includes a base, a plurality of stationary switch contacts connected with said base, a plurality of movable switch contacts connected with said base, an actuator link connected with said movable switch contacts, a plurality of light sources, and a plurality of conductors which extend through said actuator link and are connected with said light sources, said actuator link being movable relative to said conductors to move said movable switch contacts relative to said stationary switch contacts.

12. An apparatus as set forth in claim 11 wherein each of said conductors is connected with one of said switch terminals.

13. An apparatus is set forth in claim 11 wherein each of said conductors is integrally formed as one piece with one of said switch terminals.

14. An apparatus as set forth in claim 1 wherein said switch assembly includes a plurality of stationary switch contacts and a plurality of movable switch contacts, said plurality of movable and stationary switch contacts includes first and second stationary switch contacts and a first movable switch contact which is movable between said first stationary switch contact and said second stationary switch contact, a conductor connected with said first stationary switch contact and a first switch terminal of said plurality of switch terminals, and a body of insulating material disposed in engagement with said second stationary switch contact and with at least one of said conductor and said first switch terminal to enable said second stationary switch contact to be disposed close to at least one of said conductor and first switch terminal.

15. An apparatus as set forth in claim 1 wherein said switch assembly includes a plurality of stationary switch contacts, a plurality of movable switch contacts which are movable relative to said stationary switch contacts, a light module housing having first and second portions, said movable switch contacts being at least partially enclosed by said first portion of said light module housing, a plurality of light sources disposed in said second portion of said light module housing, and a push button connected with said movable switch contacts, said push button being at least partially illuminated by light from said light sources upon energization of said light sources.

16. An apparatus as set forth in claim 15 wherein said switch assembly includes a base from which said switch terminals extend in a direction away from said push button, said light module housing having a retainer which snaps into an opening in said base to interconnect said light module housing and said base.

17. An apparatus as set forth in claim 15 further including an actuator link which is at least partially enclosed by said first portion of said light module housing and is connected with said push button, and a plurality of conductors which extend through openings in said actuator link and are connected with said light sources.

18. An apparatus as set forth in claim 17 wherein each of said conductors is integrally formed as one piece with one of said switch terminals.

19. An apparatus comprising a switch housing, a base which is at least partially enclosed by and is connected with said switch housing, a plurality of switch terminals which are connected with said base, a plurality of stationary and movable switch contacts connected with said switch terminals, a light module housing which is at least partially enclosed by said switch housing, said light module housing having a first portion in which said movable switch contacts are at least partially disposed, said light module housing having a second portion, a plurality of light sources are disposed in said second portion of said light module housing, and a push button which is at least partially enclosed by said switch housing and is disposed adjacent to said second portion of said light module housing, said push button being connected with said movable switch contacts, said push button being at least partially illuminated by light from said light sources upon energization of said light sources.

20. An apparatus as set forth in claim 19 further including an outer housing which at least partially encloses said switch housing and said plurality of switch terminals, said switch housing having a switch housing locating surface which engages a first locating surface on said outer housing to position said switch housing relative to said outer housing, a connector terminal block which is at least partially enclosed by said outer housing, said connector terminal block having a connector terminal block locating surface which engages a second locating surface on said outer housing to position said connector terminal block relative to said outer housing, and a plurality of connector terminals which are at least partially disposed in said connector terminal block, each of said connector terminals having an inner end portion which engages one of said switch terminals and a second end portion which is connectable with an electrical conductor.

21. An apparatus as set forth in claim 20 further including first and second openings formed in said outer housing, said switch housing having a switch housing retainer which snaps into the first opening in said outer housing, said connector terminal block having a connector terminal block retainer which snaps into the second opening in said outer housing.

22. An apparatus as set forth in claim 21 wherein said outer housing includes a first mounting flange which is integrally formed as one piece with said outer housing and a second mounting flange which is integrally formed as one piece with said outer housing.

23. An apparatus as set forth in claim 19 wherein said stationary and movable switch contacts include first and second spaced apart stationary switch contacts and a movable switch contact which is disposed between said first and second stationary switch contacts, a conductor connected with said first stationary switch contact, a body of insulating material disposed in engagement with said conductor, said second stationary switch contact being disposed in engagement with said body of insulating material.

24. An apparatus as set forth in claim 19 further including an actuator link which is connected with said push button and said movable switch contacts, said actuator link being at least partially disposed in said first portion of said light module housing, and a plurality of conductors which extend through said actuator link and are connected with said light sources, said actuator link being movable to move said movable switch contacts relative to said stationary switch contacts upon movement of said push button relative to said switch housing.

25. An apparatus as set forth in claim 24 wherein each of said conductors is integrally formed as one piece with one of said switch terminals.

26. An apparatus as set forth in claim 19 wherein said light module housing includes a first retainer which engages an opening in said base to interconnect said base and said light module housing, said light module housing having a second retainer which engages an opening in said switch housing to interconnect said switch housing and said light module housing.

27. An apparatus as set forth in claim 19 wherein said push button extends around and at least partially encloses at least a portion of said light module housing.

28. An apparatus as set forth in claim 19 wherein said second portion of said light module housing is divided into first and second sections by a wall which blocks transmission of light between said first and second sections of said second portion of said light module housing, a first group of said light sources of said plurality of light sources being disposed in said first section of said second portion of said light module housing, a second group of said light sources of said plurality of light sources being disposed in said second section of said second portion of said light module housing.

29. An apparatus as set forth in claim 19 wherein said light module housing includes a panel which separates said first portion from said second portion of said light module housing, said light sources being disposed adjacent to a side of said panel which faces toward said push button.

30. An apparatus as set forth in claim 19 further including a printed circuit board having an opening, and a projection extending from said base into the opening in said printed circuit board, said projection being engagable with a discontinuity in said opening in said printed circuit board to orient said switch housing and said push button relative to said printed circuit board.

31. An apparatus as set forth in claim 30 further including an alternate action mechanism connected with said push button and said movable switch contacts, said alternate action mechanism being operable to maintain said movable switch contacts in an actuated condition in response to a first manual actuation of said push button and to release said movable switch contacts in response to a second manual actuation of said push button, said alternate action mechanism being at least partially disposed in said projection.

32. An apparatus as set forth in claim 30 wherein said printed circuit board includes an array of sockets adjacent to the opening in said printed circuit board, each of said terminals of said plurality of terminals extends into one of said sockets in said array of sockets.

33. An apparatus comprising a switch housing, a base which is at least partially endosed by and is connected with said switch housing, a plurality of switch terminals which are connected with said base, a plurality of movable and stationary switch contacts connected with said switch terminals and at least partially enclosed by said switch housing, said plurality of movable and stationary switch contacts includes first and second stationary switch contacts which are spaced apart and a first movable switch contact which is movable between said first stationary switch contact and said second stationary switch contact, a conductor connected with said first stationary switch contact and a first switch terminal of said plurality of switch terminals, and a body of insulating material disposed in engagement with said second stationary switch contact and with at least one of said conductor and first switch terminal to enable said second stationary switch contact to be disposed dose to said one of said conductor and first switch terminal.

34. An apparatus as set forth in claim 33 wherein said body of insulating material at least partially covers said conductor and at least partially covers said first switch terminal.

35. An apparatus as set forth in claim 33 wherein said second stationary switch contact is aligned with and is spaced from an end portion of said first switch terminal, said body of insulating material fills the space between the second stationary switch contact and the end portion of said first switch terminal.

36. An apparatus as set forth in claim 33 wherein said conductor is connected with an end portion of said first switch terminal, said body of insulating material engages both said end portion of said first switch terminal and said conductor, said body of insulating material fills a space between said second stationary switch contact and both said end portion of said first switch terminal and said conductor.

37. An apparatus as set forth in claim 33 further including an outer housing, said switch housing being at least partially disposed in said outer housing, said switch housing having a switch housing locating surface which engages a first locating surface on said outer housing to position said switch housing relative to said outer housing, a connector terminal mounting block which is at least partially disposed in said outer housing, said connector terminal block having a connector terminal locating surface which engages a locating surface on said outer housing to position said connector terminal block relative to said outer housing, and a plurality of connector terminals which are at least partially disposed in said connector terminal block, each of said connector terminals having an inner end portion which telescopically engages one of said switch terminals and a second end portion which is connectable with an electrical conductor.

38. An apparatus as set forth in claim 37 wherein said outer housing includes a plurality of side walls which extend between opposite ends of said outer housing, said first locating surface on said outer housing being at least partially disposed on an end of one of said side walls of said outer housing, said second locating surface on said outer housing being at least partially disposed on an end of one of said side walls of said outer housing.

39. An apparatus as set forth in claim 38 further including first and second openings formed in said side walls of said outer housing, said switch housing having a switch housing retainer which snaps into the first opening in said side walls of said outer housing, said connector terminal mounting block having a connector terminal mounting block retainer which snaps into the second opening in said side walls of said outer housing.

40. An apparatus as set forth in claim 37 further including a light module housing which at least partially encloses said movable switch contacts, said light module housing having a first light module housing retainer which snaps into an opening in said base to interconnect said light module housing and said base, said light module housing having a second light module housing retainer which snaps into an opening in said switch housing to interconnect said light module housing and said switch housing, and a plurality of light sources disposed in said light module housing.

41. An apparatus as set forth in claim 40 wherein said switch assembly further includes a push button which is movable relative to said light module housing and said base to move said movable switch contacts relative to said fixed switch contacts and said base, said movable switch contacts being disposed between said base and said push button.

42. An apparatus as set forth in claim 37 wherein said switch housing includes a rim which extends around said switch housing, said switch housing locating surface being disposed on said rim of said switch housing, said connector terminal mounting block includes a rim which extends around said connector terminal mounting block, said connector terminal mounting block housing locating surface being disposed on said rim of said connector terminal block.

43. An apparatus as set forth in claim 33 further including a light module housing which is at least partially endosed by said switch housing said light module housing having a first portion in which said movable switch contacts are at least partially disposed, said light module housing having a second portion, a plurality of light sources disposed in said second portion of said light module housing, and a push button which is at least partially enclosed by said switch housing and is disposed adjacent to said second portion of said light module housing, said push button being connected with said movable switch contacts, said push button being at least partially illuminated by light from said light sources upon energization of said light sources.

44. An apparatus as set forth in claim 43 further including an actuator link which is connected with said push button and said movable switch contacts, said actuator link being at least partially disposed in said first portion of said light module housing, and a plurality of conductors which extend through said actuator link and are connected with said light sources, said actuator link being movable relative to said conductors which extend through said actuator link to move said movable switch contacts relative to said stationary switch contacts upon movement of said push button relative to said switch housing.

45. An apparatus as set forth in claim 44 wherein each of said conductors which extends through said actuator link is integrally formed as one piece with one of said switch terminals.

46. An apparatus as set forth in claim 43 wherein said light module housing includes a first retainer which engages an opening in said base to interconnect said base and said light module housing, said light module housing having a second retainer which engages an opening in said switch housing to interconnect said switch housing and said light module housing.

47. An apparatus as set forth in claim 43 wherein said push button extends around and at least partially encloses at least a portion of said light module housing.

48. An apparatus as set forth in claim 43 wherein said second portion of said light module housing is divided into first and second sections by a wall which blocks transmission of light between said first and second sections of said second portion of said light module housing, a first group of said light sources of said plurality of light sources being disposed in said first section of said second portion of said light module housing, a second group of said light sources of said plurality of light sources being disposed in said second section of said second portion of said light module housing.

49. An apparatus as set forth in claim 43 wherein said light module housing includes a panel which separates said first portion of said light module housing from said second portion of said light module housing, said light sources being disposed adjacent to a side of said panel which faces toward said push button.

50. An apparatus as set forth in claim 33 wherein said conductor is rigid and supports said first stationary switch contact in a spaced apart relationship with said second stationary switch contact.

51. An apparatus as set forth in claim 33 wherein said first stationary switch contact is disposed above said second stationary switch contact, said conductor extends from said first stationary switch contact to a location beneath said second stationary switch contact, said body of insulating material being disposed in engagement with a portion of said conductor which is disposed beneath said second stationary contact, said conductor having a portion which extends from said first stationary switch contact past said first movable switch contact toward said second stationary switch contact and is free of engagement with insulating material.

52. An apparatus comprising a switch housing, a base which is at least partially enclosed by and is connected with said switch housing, a plurality of terminals which are connected with said base, a plurality of stationary and movable switch contacts connected with said terminals, a push button which is at least partially enclosed by said switch housing, an actuator link connected with said push button and said movable switch contacts, a plurality of light sources disposed in said switch housing, and a plurality of conductors which extend through said actuator link and are connected with said light sources, said actuator link being movable relative to said conductors to move said movable switch contacts relative to said stationary switch contacts upon movement of said push button relative to said switch housing, said push button being at least partially illuminated by light from said light sources upon energization of said light sources.

53. An apparatus as set forth in claim 52 wherein said stationary switch contacts are disposed in an array which extends around said conductors.

54. An apparatus as set forth in claim 52 wherein each of said conductors is connected with one of said terminals of said plurality of terminals.

55. An apparatus as set forth in claim 52 further including a body of insulating material disposed in engagement with one of said stationary contacts and one of said terminals.

56. An apparatus as set forth in claim 52 wherein push button and actuator link are movable together relative to said stationary switch contacts and said conductors to move said movable switch contacts under the influence of force transmitted from said push button.

57. An apparatus as set forth in claim 52 wherein each of said conductors is integrally formed as one piece with one of said switch terminals.

58. An apparatus as set forth in claim 52 further including a panel connected with said switch housing and having a first side facing toward said push button and a second side facing toward said actuator link, at least one of said light sources of said plurality of light sources being disposed adjacent to said first side of said panel.

59. An apparatus as set forth in claim 52 wherein electrical energy is conducted from said switch terminals through said conductors to energize said light sources.

60. An apparatus as set forth in claim 52 further including a spring disposed between said base and said push button to urge said push button in a direction away from said base, said spring extends through an opening said actuator link.

61. An apparatus as set forth in claim 52 further including a plurality of bus elements connected with said conductors and said light sources to conduct electrical energy between said bus elements and said light sources.

62. An apparatus as set forth in claim 52 further including an outer housing, said switch housing having a switch housing locating surface which engages a first locating surface on said outer housing to position said switch housing relative to said outer housing, a connector terminal mounting block which has a connector terminal mounting block locating surface which engages a second locating surface on said outer housing to position said connector terminal block relative to said outer housing, each of said connector terminals having an inner end portion which engages one of said terminals connected with said base and a second end portion which is connected with an electrical conductor.

63. An apparatus as set forth in claim 62 further including first and second openings formed in side walls of said outer housing, said switch housing having a switch housing retainer which snaps into the first opening in said side walls of said outer housing, said connector terminal mounting block having a connector terminal mounting block retainer which snaps into the second opening in said side walls of said outer housing.

64. An apparatus as set forth in claim 52 further including a light module housing which is at least partially enclosed by said switch housing, said light module housing having a first portion in which said movable switch contacts are at least partially disposed, said light module housing having a second portion, said plurality of light sources being disposed in said second portion of said light module housing.

65. An apparatus as set forth in claim 52 further including a printed circuit board having an opening, and a projection extending from said base, into the opening in said printed circuit board, said projection being engagable with a discontinuity in said opening in said printed circuit board to orient said switch housing and said push button relative to said printed circuit board.

66. An apparatus as set forth in claim 65 further including an alternate action mechanism connected with said push button and said movable switch contacts, said alternate action mechanism being operable to maintain said movable switch contacts in an actuated condition in response to a first manual actuation of said push button and to release said movable switch contacts in response to a second manual actuation of said push button, said alternate action mechanism being at least partially disposed in said projection.

67. An apparatus as set forth in claim 66 wherein said printed circuit board includes an array of sockets extending around the opening in said printed circuit board, each of said terminals of said plurality of terminals extends into one of said sockets in said array of sockets.

68. An apparatus comprising an outer housing, a switch assembly which is at least partially disposed in said outer housing, a connector terminal mounting block which is at least partially disposed in said outer housing, and a plurality of connector terminals which are at least partially disposed in said connector terminal block, said switch assembly includes a switch housing, a base which is at least partially enclosed by said switch housing, a plurality of switch terminals which are at least partially disposed in said base and are connected with said connector terminals, a plurality of movable and stationary switch contacts which are connected with said switch terminals, a push button, an actuator link connected with said push button and said movable switch contacts, said actuator link being enclosed by said switch housing, a panel which is at least partially enclosed by said switch housing, a plurality of light sources disposed adjacent to a side of said panel which faces toward said push button, and a plurality of conductors which are connected with said switch terminals and extend through openings in said actuator link, said conductors being connected with said light sources, said actuator link being movable relative to said conductors to move said movable switch contacts relative to said stationary switch contacts, said push button being at least partially illuminated by light from said light sources upon energization of said light sources.

69. An apparatus as set forth in claim 68 further including an alternate action mechanism which is at least partially disposed adjacent to a side of said base opposite from said movable switch contacts, said alternate action mechanism is operable to maintain said movable switch contacts in an actuated condition in response to a first manual actuation of said push button and to release said movable switch contacts in response to a second manual actuation of said push button, said alternate action mechanism being at least partially disposed in an openings formed in said connector terminal mounting block.

70. An apparatus as set forth in claim 68 wherein said swich housing having a first locating surface which engages a first locating surface on said outer housing, said connector terminal mounting block having a second locating surface which engages a second locating surface on said outer housing.

71. An apparatus as set forth in claim 68 wherein said panel forms a portion of a light module housing which at least partially encloses said movable switch contacts, said panel being disposed between said movable switch contacts and said push button.

72. An apparatus as set forth in claim 68 wherein each of said conductors is integrally formed as one piece with one of said switch terminals.

73. An apparatus as set forth in claim 68 wherein said plurality of movable and stationary switch contacts includes first and second stationary switch contacts which are spaced apart and a first movable switch contact which is movable between a first position engaging said first stationary switch contact and a second position engaging said second stationary switch contact, a conductor connected with said first stationary switch contact and a first switch terminal of said plurality of switch terminals, and a body of insulating material disposed in engagement with said second stationary switch contact and with at least one of said conductor and said first switch terminal to enable said second stationary switch contact to be disposed close to said one of said conductor and first switch terminal.

74. An apparatus comprising a switch housing, a base which has a first side and a second side opposite from said first side, said base being at least partially enclosed by and connected with said switch housing, a plurality of terminals which extend from said second side of said base, a plurality of stationary and movable switch contacts connected with said first side of said base and connected with said terminals, a push button which is at least partially enclosed by said switch housing, an actuator link connected with said movable switch contacts, said actuator link being disposed between said first side of said base and said push button, a force transmitting member which is connected with said push button and with said actuator link, and an alternate action mechanism which is at least partially disposed adjacent to said second side of said base, said alternate action mechanism is operable to maintain said movable switch contacts in an actuated condition in response to a first manual actuation of said push button and to release said movable switch contacts in response to a second manual actuation of said push button, said alternate action mechanism being connected with said force transmitting member to enable force applied to said push button to be transmitted through said base to said alternate action mechanism.

75. An apparatus as set forth in claim 74 further including an outer housing, a connector terminal mounting block at least partially enclosed by said outer housing, and a plurality of connector terminals which are at least partially disposed in said connector terminal mounting block, each of said connector terminals being connected with one of said terminals which extend from said second side of said base.

76. An apparatus as set forth in claim 75 wherein said alternate action mechanism is at least partially disposed in an opening formed in said connector terminal mounting block.

77. An apparatus as set forth in claim 74 further including a plurality of conductors which extend through openings in said actuator link, said actuator link being movable relative to said conductors to move said movable switch contacts relative to said stationary switch contacts.

78. An apparatus as set forth in claim 77 further including a panel disposed between said actuator link and said push button, a plurality of light sources disposed on said panel and connected with said conductors, said light sources being energizable to at least partially illuminate said push button.

79. An apparatus as set forth in claim 74 further including a printed circuit board having an opening with an array of sockets extending around the opening, each of said terminals of said plurality of terminals extends into one of said sockets in said array of sockets, said alternate action mechanism extends into said opening in said printed board.

80. An apparatus as set forth in claim 74 further including a printed circuit board having an opening, said alternate action mechanism extends into the opening in said printed circuit board.

* * * * *

UNITED STATES PATENT AND TRADEMARK OFFICE

CERTIFICATE OF CORRECTION

PATENT NO. : 6,770,829 B1
DATED : August 3, 2004
INVENTOR(S) : Roy L. Hart

It is certified that error appears in the above-identified patent and that said Letters Patent is hereby corrected as shown below:

Column 29,
Line 37, after "partially" change "endosed" to -- enclosed --.
Line 52, after "disposed" change "dose" to -- close --.

Column 30,
Line 61, after "partially" change "endosed" to -- enlosed --.

Signed and Sealed this

Fifth Day of April, 2005

JON W. DUDAS
*Director of the United States Patent and Trademark Office*